US007188479B2

(12) United States Patent
Anselmino et al.

(10) Patent No.: US 7,188,479 B2
(45) Date of Patent: Mar. 13, 2007

(54) ICE AND WATER DISPENSER ON REFRIGERATOR COMPARTMENT DOOR

(75) Inventors: Jeffery J. Anselmino, St. Joseph, MI (US); Marcus R. Fischer, St. Joseph, MI (US); Tushar Kulkarni, St. Joseph, MI (US); Andrew M. Tenbarge, St. Joseph, MI (US); Frank W. Maglinger, Evansville, IN (US)

(73) Assignee: Whirlpool Corporation, Benton Harbor, MI (US)

( * ) Notice: Subject to any disclaimer, the term of this patent is extended or adjusted under 35 U.S.C. 154(b) by 69 days.

(21) Appl. No.: 10/973,543

(22) Filed: Oct. 26, 2004

(65) Prior Publication Data

US 2006/0086130 A1 Apr. 27, 2006

(51) Int. Cl.
*F25C 1/00* (2006.01)

(52) U.S. Cl. ..... 62/66; 62/135; 62/340; 62/420

(58) Field of Classification Search ..... 62/66–74, 62/135–138, 340–356, 407–426
See application file for complete search history.

(56) References Cited

U.S. PATENT DOCUMENTS

| | | | | |
|---|---|---|---|---|
| 2,199,413 A | | 5/1940 | Patrignani | 62/116 |
| 2,900,803 A | | 8/1959 | Horton, Jr. | 62/157 |
| 3,025,679 A | * | 3/1962 | Keighley | 62/71 |
| 3,025,683 A | | 3/1962 | Baker et al. | 62/419 |
| 3,146,601 A | | 9/1964 | Gould | 62/3 |
| 3,545,217 A | | 12/1970 | Linstromberg | 62/137 |
| 3,789,620 A | | 2/1974 | Benasutti et al. | 62/344 |
| 3,933,198 A | | 1/1976 | Hara et al. | 165/32 |
| 4,368,622 A | | 1/1983 | Brooks | 62/157 |
| 4,970,871 A | | 11/1990 | Rudick | 62/187 |
| 5,211,462 A | | 5/1993 | Bien et al. | 312/404 |
| 5,272,888 A | | 12/1993 | Fisher et al. | 62/344 |
| 5,896,752 A | * | 4/1999 | Park | 62/186 |
| 6,050,097 A | | 4/2000 | Nelson et al. | 62/137 |
| 6,082,130 A | | 7/2000 | Pastryk et al. | 62/344 |
| 6,085,542 A | | 7/2000 | Johnson et al. | 62/441 |
| 6,148,624 A | | 11/2000 | Bishop et al. | 62/137 |
| 6,735,959 B1 | | 5/2004 | Najewicz | 62/3.63 |
| 6,945,068 B2 | * | 9/2005 | Kim et al. | 62/353 |
| 6,964,177 B2 | | 11/2005 | Lee et al. | 62/320 |
| 7,076,967 B2 | | 7/2006 | Lee et al. | 62/353 |

* cited by examiner

*Primary Examiner*—William E. Tapolcai
(74) *Attorney, Agent, or Firm*—Robert O. Rice; Stephen Krefman; John F. Colligan

(57) ABSTRACT

An ice and water dispenser for a bottom freezer refrigerator positioned on a refrigerator compartment door. The ice maker and ice cube storage bin can have below 0° C. air provided to maintain the ice maker and ice cube storage bin below 0° C. Supply and return ducts can convey below 0° C. air to the ice maker and ice cube storage bin. The supply and return ducts can lead from the bottom freezer compartment or from an evaporator compartment. The ice maker and ice cube storage bin can be located in insulated sub-compartment to allow normal refrigerator compartment temperatures to be maintained in the above freezing refrigerator compartment.

47 Claims, 15 Drawing Sheets

ICE AND WATER DISPENSER ON REFRIGERATOR COMPARTMENT DOOR

CROSS REFERENCE TO RELATED APPLICATIONS

This application is related to the following U.S. patent applications filed concurrently herewith: US20020155 and US20040124.

BACKGROUND OF THE INVENTION

1. Field of the Invention

The invention relates to an ice and water dispenser positioned on the refrigerator compartment door of a bottom freezer refrigerator.

2. Description of the Related Art

Automatic ice making systems for use in refrigerator freezers are well known. Typically, ice making systems include an ice maker mounted in the freezer compartment with an ice cube storage bin supported under the ice maker. Ice making systems may also include ice dispensing systems for delivering ice cubes through a dispenser on the face of the refrigerator freezer. Side by side refrigerator freezers typically have the ice dispenser on the face of the freezer compartment door. Side by side refrigerator freezers can have the ice storage bin, and even the ice maker positioned on the freezer compartment door.

Automatic ice making systems mounted in the refrigerator compartment or on the refrigerator compartment door are also known. Top freezer or side by side refrigerators having an automatic ice maker in the freezer compartment and an ice dispenser on the face of the refrigerator compartment door are also known.

SUMMARY OF THE INVENTION

The invention relates to an ice maker and dispenser for a bottom freezer refrigerator having a freezer compartment maintained at a temperature below 0° C., a refrigerator compartment positioned above the freezer compartment maintained at a temperature above 0° C., an insulated freezer compartment door, an insulated refrigerator compartment door, and a refrigeration system for cooling the freezer compartment and the refrigerator compartment. The ice maker is positioned on the refrigerator compartment door, an ice cube storage bin is positioned on the refrigerator door below the ice maker, and an ice dispenser positioned on the refrigerator door for dispensing ice pieces from the ice cube storage bin through the refrigerator door. The bottom freezer refrigerator includes an air delivery system leading to the ice maker and ice cube storage bin from a source of below 0° C. air for supplying air cooled to below 0° C. to the ice maker and to the ice storage bin.

The air delivery system can lead from the freezer compartment to the ice maker and ice cube storage bin and can include a supply duct and a return duct. The supply duct and return duct can each include a first air delivery portion carried on the refrigerator compartment door and a second air delivery portion leading from the bottom of the refrigerator door to the freezer compartment.

The supply duct and return duct can include a seal to seal the first air delivery portion to the second air delivery portion when the refrigerator door is closed.

The air delivery system can include an ice maker fan connected to the air delivery system wherein operation of the ice maker fan causes air from the below freezing compartment to flow to the ice maker and to the ice cube storage bin and return to the freezer compartment. The ice maker fan can be connected to the return duct so that the ice maker fan draws below 0° C. air from the freezer compartment through the supply duct to the ice maker and ice cube storage bin and then through the return duct to the ice maker fan. The ice maker fan can discharge air from the return duct into the freezer compartment.

In another aspect the invention relates to an air delivery system for a bottom freezer refrigerator that leads from the evaporator compartment of the refrigeration system to the ice maker and ice cube storage bin.

In another aspect the invention relates to an ice maker and dispenser for a bottom freezer refrigerator having a freezer compartment maintained at a temperature below 0° C., a refrigerator compartment positioned above the freezer compartment maintained at a temperature above 0° C., an insulated freezer compartment door, an insulated refrigerator compartment door, and a refrigeration system for cooling the freezer compartment and the refrigerator compartment. An ice maker is positioned in an insulated ice maker sub-compartment on the refrigerator compartment door, an insulated ice cube storage bin is positioned on the refrigerator door below the ice maker, and an ice dispenser is positioned on the refrigerator door below the ice cube storage bin for dispensing ice pieces from the ice cube storage bin through the refrigerator door. An air delivery system leads to the ice maker and ice cube storage bin from a source of below 0° C. air for supplying air cooled to below 0° C. to the ice maker and to the ice storage bin.

The ice cube storage bin can be positioned in an insulated ice cube storage bin sub-compartment on the refrigerator door. The insulated ice cube storage bin sub-compartment can comprise a space enclosed by an insulated cover movably carried by the refrigerator compartment door. The insulated cover can be transparent and the insulated cover can be pivotally mounted on the refrigerator door. The insulated cover can include a gasket for forming a seal to the refrigerator door liner.

In another aspect the insulated ice cube storage bin comprises side walls and a bottom wall formed of insulating material. The ice cube storage bin can be formed of clear insulating double wall material.

In another aspect the invention relates to an ice maker and dispenser for a bottom freezer refrigerator having a freezer compartment maintained at a temperature below 0° C., a refrigerator compartment positioned above the freezer compartment maintained at a temperature above 0° C., an insulated freezer compartment door, an insulated refrigerator compartment door, and a refrigeration system for cooling the freezer compartment and the refrigerator compartment. An ice maker is positioned in an insulated ice maker sub-compartment on the refrigerator compartment door having a mold for forming ice pieces, an ice cube storage bin is positioned on the refrigerator door below the ice maker, and an ice dispenser is positioned on the refrigerator door below the ice cube storage bin for dispensing ice pieces from the ice cube storage bin through the refrigerator door. The bottom freezer refrigerator includes air delivery system having a supply duct and a return duct leading to the ice maker and ice cube storage bin from a source of below 0° C. air for supplying air cooled to below 0° C. to the ice maker and to the ice storage bin. The air delivery system includes an ice maker fan connected to the air delivery system wherein operation of the ice maker fan causes air from the source of below 0° C. air to flow to the ice maker and to the ice storage bin. The supply duct and the return duct include a first air delivery portion carried on the refrigerator door and a second air delivery portion leading from the bottom of the refrigerator door to the source of below 0° C. air.

The first air delivery portion of the supply duct and the return duct includes a vertical portion extending from the bottom of the refrigerator door to the ice maker sub-compartment.

The ice maker mold includes side walls and a bottom wall and the ice maker further comprises a housing enclosing the side walls and bottom wall of the ice mold forming an air flow passage around the ice maker mold. The housing includes side walls and a bottom wall spaced from the side walls and bottom wall of the ice mold and the air flow passage comprises the space between the ice mold and the housing.

The ice maker mold can include a plurality of fins extending from the side walls and bottom wall of the ice mold and extending substantially to the side walls and bottom wall of the housing. The fins can be arranged to form an elongated air flow passage around the bottom and sides of the ice maker mold.

A supply connector can be provided to lead from the outlet in the top of the vertical portion of the supply duct to the air flow passage around the ice maker mold. A return connector can be provided to lead from the air flow passage around the ice maker mold to the return duct.

An inlet port can be provided in the vertical portion of the supply duct adjacent the ice cube storage bin and an outlet port can be provided in the vertical portion of the return duct adjacent the ice storage bin. An ice cube storage bin damper can be provided to control air flow through one or both of the inlet port and the outlet port.

An ice cube storage bin temperature sensor can be positioned adjacent the ice cube storage bin and connected to a control to regulate the position of the ice cube storage bin damper in response to the temperature sensed by the ice cube storage bin temperature sensor. The ice storage damper can be a two position damper arranged to open or close one or both of the inlet and outlet ports.

In another aspect of the invention the ice storage damper can be continuously adjustable in response to the temperature sensed by the ice cube storage bin temperature sensor.

Another aspect of the invention relates to an ice maker and dispenser for a bottom freezer refrigerator a freezer compartment maintained at a temperature below 0° C., a refrigerator compartment positioned above the freezer compartment maintained at a temperature above 0° C., an insulated freezer compartment door, an insulated refrigerator compartment door, and a refrigerator system for cooling the freezer compartment and the refrigerator compartment including a compressor. An automatic ice maker is positioned on the refrigerator compartment door, an ice cube storage bin is positioned on the refrigerator door below the ice maker, an ice cube storage bin temperature sensor is positioned adjacent the ice storage bin, and an ice dispenser positioned on the refrigerator door below the ice cube storage bin for dispensing ice pieces from the ice cube storage bin through the refrigerator door. An air delivery system is provided leading to the ice maker and ice cube storage bin from a source of below 0° C. air for supplying air cooled to below 0° C. to the ice maker and ice cube storage bin and having at least one port adjacent the ice storage bin, an ice cube storage bin damper to control air flow through the at least one port, and an ice maker fan connected to the air delivery system wherein operation of the ice maker fan causes air from the source of below 0° C. air to flow to the ice maker and to the ice storage bin. An ice maker control is provided for the automatic ice maker, the ice maker fan and the ice cube storage bin damper to open the ice cube storage bin damper and operate the ice maker fan when the ice cube storage bin temperature sensor indicates ice cube storage bin needs cooling, and to operate the ice maker fan when the ice maker is producing ice.

The control can include a quick ice mode of operation and the compressor can be arranged to operate at multiple speeds including high speed and the ice maker fan can be arranged to operate at a high speed and a normal speed. In the quick ice mode the control is arranged to operate the compressor at high speed and the ice maker fan at high speed.

The bottom freezer refrigerator can include a freezer temperature controller and a refrigerator compartment controller connected to the ice maker control. The ice maker control can be arranged to reduce the compressor speed when the freezer compartment temperature control or the refrigerator compartment temperature control sense a temperature below a predetermined temperature in the refrigerator compartment or the freezer compartment.

The ice maker control can be arranged to operate the ice maker fan at normal speed when the quick ice mode is not selected. The ice maker control can be arranged to turn off the compressor in the event the freezer compartment or refrigerator compartment temperature controls sense a temperature below a predetermined temperature and the compressor is operating at the lowest speed.

The ice maker control can be arranged to stop the ice maker fan when the ice cube storage bin temperature sensor indicates the ice cube storage bin does not need cooling.

In another aspect the invention relates to the method of producing ice cubes in a bottom freezer refrigerator having a refrigerator compartment maintained at a temperature above 0° C. positioned above a freezer compartment maintained at a temperature below 0° C., a refrigeration system for cooling the refrigerator and freezer compartments, and an automatic ice maker positioned on the refrigerator compartment door comprising the steps of operating the refrigeration system to provide cooling to the refrigerator and freezer compartments, filling the ice maker with water, and supplying the ice maker with below 0° C. air for forming ice cubes.

The step of supplying below 0° C. air can comprise causing below 0° C. air to flow through an air delivery system leading from a source of below 0° C. air to the ice maker. The step of supplying below 0° C. air can comprise causing below 0° C. air to flow through a supply duct to the ice maker and returning below 0° C. air from the ice maker through a return duct.

The bottom freezer refrigerator can include an ice cube storage bin on the refrigerator compartment door below the ice maker and the method of producing ice cubes further includes the step of supplying below 0° C. air to the ice storage bin.

In another aspect the invention relates to a method of producing and storing ice pieces in a bottom freezer refrigerator having a freezer compartment maintained at a temperature below 0° C., a refrigerator compartment positioned above the freezer compartment maintained at a temperature above 0° C., an insulated refrigerator compartment door, and a refrigeration system for cooling the freezer compartment and the refrigerator compartment having a compressor. An ice maker is positioned on the refrigerator door, an ice cube storage bin is positioned on the refrigerator door below the ice maker, and an air delivery system is provided leading to the ice maker and ice cube storage bin from a source of below 0° C. air for supplying air cooled to below 0° C. to the ice maker and ice cube storage bin and having at least one port adjacent the ice bin and having an ice bin damper for selectively opening and closing the at least one port. An ice maker fan is connected to the air delivery system wherein operation of the ice maker fan supplies air cooled to below 0° C. to the ice maker and ice cube storage bin, and the method comprises opening the ice maker damper and operating the ice maker fan when the ice cube storage bin needs cooling and closing the ice maker damper when the ice cube storage bin no longer requires cooling.

The automatic ice maker can have a quick ice mode of operation and the method of producing and storing ice pieces can further comprises operating the compressor at high speed and the ice maker fan at high speed when the quick mode is requested, and reducing the compressor speed when the refrigerator or freezer compartment temperatures are below a predetermined minimum temperature.

The method of producing and storing ice pieces can include the step of turning off the compressor if the step of reducing the compressor speed reduces the compressor speed below a predetermined minimum speed. The method can further comprise operating the ice maker fan at the normal speed when the quick ice mode is not requested.

The method of producing and storing ice pieces can include the step of operating the ice maker fan when ice is requested form the ice maker. The method can include the step of stopping the ice maker fan when ice is not requested from the ice maker and the ice cube storage bin does not require cooling.

DETAILED DESCRIPTION OF THE INVENTION

There are three basic configurations of refrigerator freezers for consumers to choose from, a bottom freezer configuration, a top freezer configuration and a side by side configuration. For consumers that desire to have an ice and water dispenser on the exterior of their refrigerator freezer the choice is essentially reduced to the side by side configuration. Bottom freezer refrigerators are desirable for the easy access to the refrigerator compartment. Thus, many consumers are torn between the easy refrigerator compartment access bottom freezer refrigerators offer and the availability of ice and water dispensing in the side by side configuration. Most refrigerator freezers having ice dispensers are configured with the ice cube storage bin positioned below the ice maker in the freezer compartment and the ice dispenser positioned on the freezer compartment door below the ice cube storage bin. This arrangement is not practical for bottom freezer refrigerators since the ice dispenser would be at the very bottom of the freezer compartment door adjacent to the floor.

Figure 1:
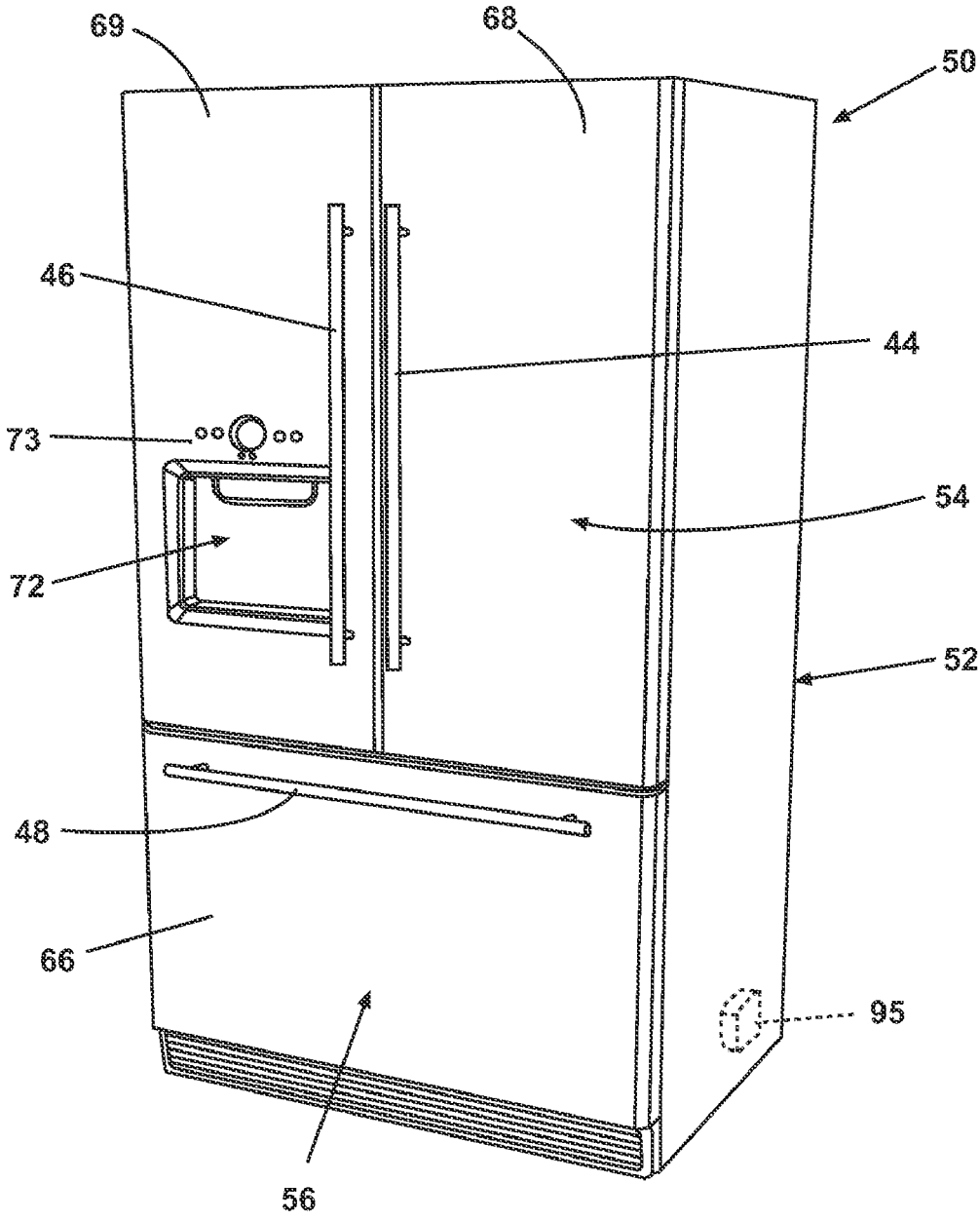
FIG. 1 is a perspective view of a bottom freezer refrigerator having an ice maker and ice and water dispenser according to the present invention positioned on a refrigerator compartment door.
Figure 2:
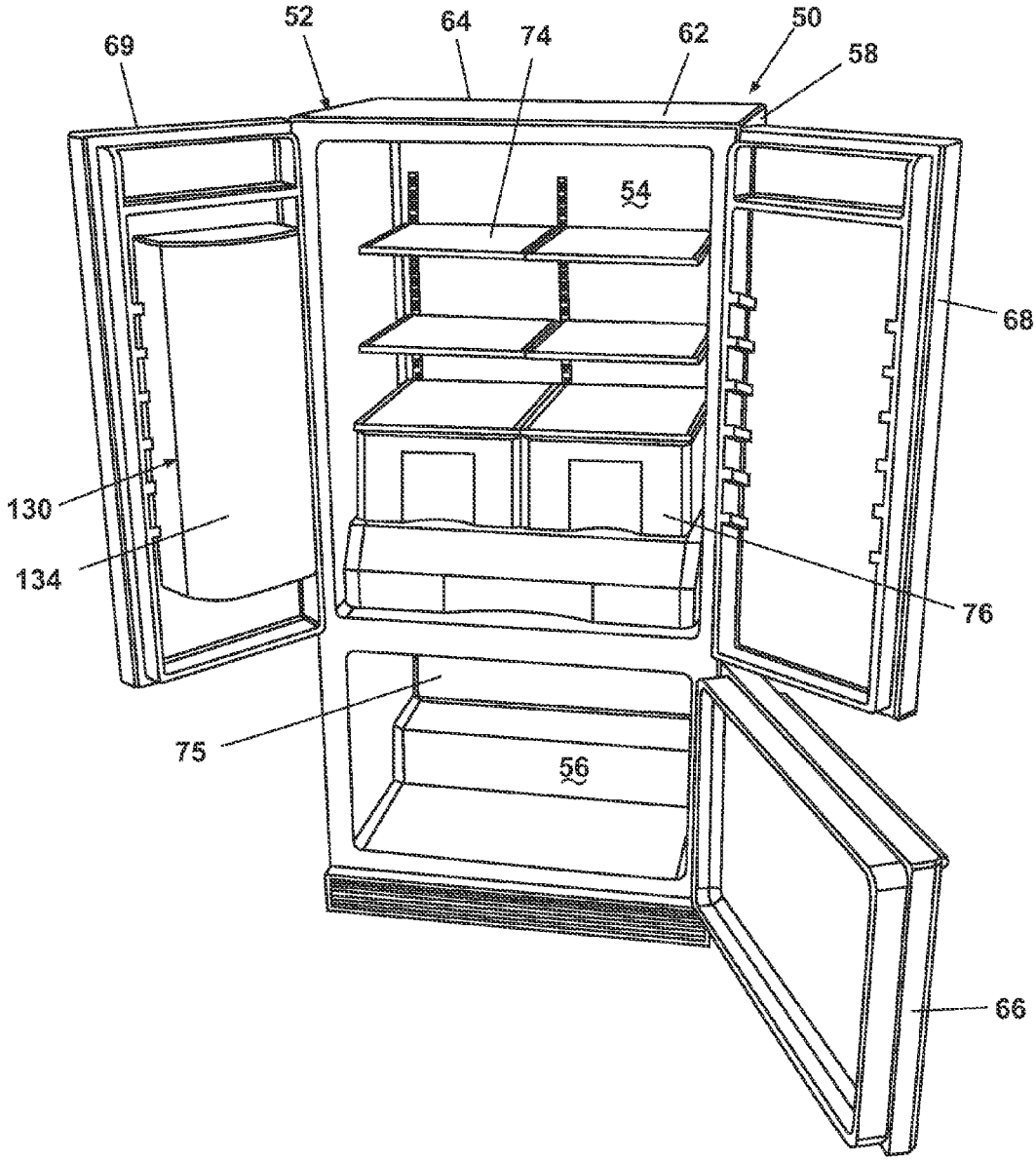
FIG. 2 is a perspective view of the bottom freezer refrigerator shown in FIG. 1 with the refrigerator compartment and freezer compartment doors open.

According to the present invention, the ice maker, ice cube storage bin and ice dispenser can be positioned on a refrigerator compartment door. Turning to FIG. 1 and FIG. 2, a bottom freezer refrigerator having an ice maker and dispenser apparatus according to the invention can be seen. Bottom freezer refrigerator 50 can have a cabinet 52 including a refrigerator compartment 54 maintained at above 0° C. temperatures and a freezer compartment 56 maintained at below 0° C. temperatures. Freezer compartment 56 is positioned in the bottom of cabinet 52 and refrigerator compartment 54 is positioned above freezer compartment 56. In the embodiment of FIG. 1 and FIG. 2, bottom freezer 50 can have two refrigerator compartment doors 68 and 69 arranged side by side. The bottom freezer refrigerator 50 configuration shown in FIG. 1 and FIG. 2 is sometimes referred to as a French door bottom mount refrigerator freezer. Conventional door handles 44, 46 and 48 are shown on refrigerator compartment doors 68 and 69 and freezer compartment door 66. Those skilled in the art will readily understand that different handles, or no handles, can be provided for the doors as is well known in the art. Refrigerator compartment 54 can include a plurality of shelves 74 that can be fixed or can be adjustable as shown in FIG. 2. One or more bins 76 can be provided in refrigerator compartment 54 for storing food items such as meats, vegetables, fruit and other food items that can benefit from storage in a closed receptacle that can be temperature and/or humidity controlled as is well known in the art. Likewise, one or more shelves or baskets (not shown) can be provided in freezer compartment 56, again as well known in the art.

Refrigerator 50 can have a refrigeration system (not shown) for cooling the refrigerator compartment 54 and freezer compartment 56. The refrigeration system can include a compressor, condenser, evaporator, evaporator fan and expansion device, all not shown, as is well known in the art. The compressor can be a variable speed compressor to provide variable cooling rates, again well known in the art. Refrigerator 50 can also have a control system (not shown) that can include temperature sensors (not shown) for the refrigerator compartment 54 and freezer compartment 56 connected to refrigerator and freezer compartment temperature controllers (not shown) to maintain the temperatures in the respective compartments at user selected temperatures. The evaporator (not shown) can be positioned in an evaporator compartment 75 that can be positioned along the back wall of the freezer compartment as is well known in the art. Refrigerator 50 can also have one or more water valves 95 positioned in the machinery compartment for supplying the ice maker and a water dispenser as is well known in the art. While water valve 95 is illustrated in the machinery compartment as a single valve those skill in the art will understand that more than one valve may be included and may be positioned in other locations in refrigerator 50 as desired. The operation of refrigerator 50 and the control system are described in more detail below in conjunction with FIG. 8 and FIG. 16.

Refrigerator compartment door 69 can include an ice and water dispenser 72 positioned on the face of the door. Ice and water dispenser 72 can be positioned on refrigerator compartment door 69 at a convenient height for user access as is well known in the art. A user interface 73 can be positioned adjacent ice and water dispenser 72 for users to select ice and water dispensing alternatives such as "quick ice" described below, and other refrigerator freezer operation parameters such as described in co-pending U.S. patent application Ser. No. 10/861,203 incorporated herein by reference. Ice making, storage and dispensing apparatus 130 can be positioned on the inside surface of refrigerator compartment door 69 and can include an insulated cover 134. Ice making, storage and dispensing apparatus 130 can be positioned to feed ice cubes to the dispenser 72 as is well known in the art. In the embodiment of FIG. 1 and FIG. 2 an air duct (not shown) can be provided leading from a source of below 0° C. air to the insulated enclosure 134 to facilitate formation and storing ice cubes. When refrigerator compartment door 69 is closed ice making, storage and dispensing apparatus 130 is positioned in refrigerated compartment 54 that is maintained above 0° C. Insulated enclosure 134 in effect forms a sub-compartment that can be maintained below 0° C. to facilitate formation and storage of ice cubes without upsetting normal above 0° C. temperatures in the refrigerator compartment 54. Alternately, ice making, storage and dispensing apparatus 130 can be located on refrigerator compartment door 68 together with ice and water dispenser 72 if desired.

Figure 3:
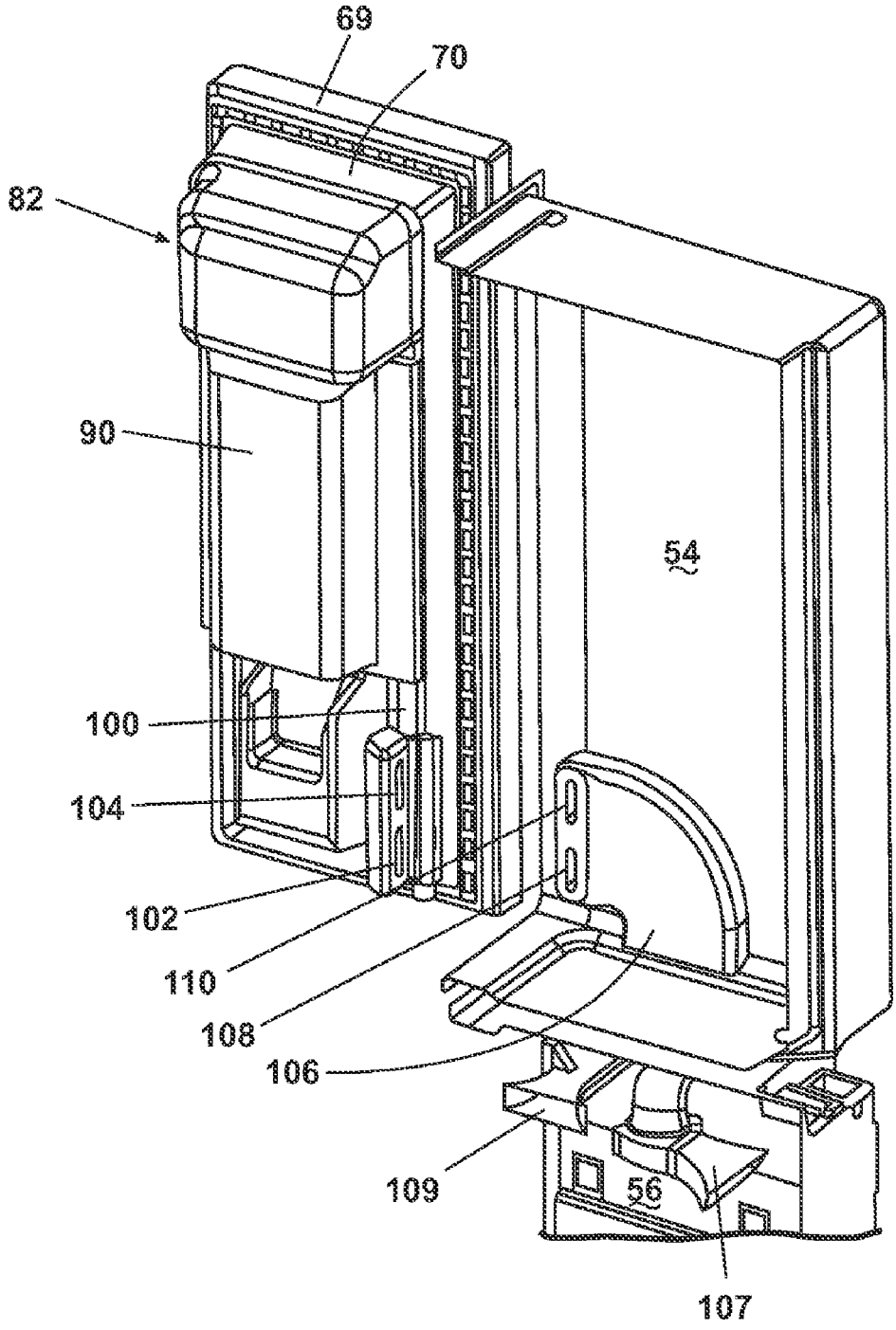
FIG. 3 is a partial perspective view of a bottom freezer refrigerator illustrating an embodiment of an ice maker and ice dispenser according to the present invention positioned on a refrigerator compartment door.
Figure 4:
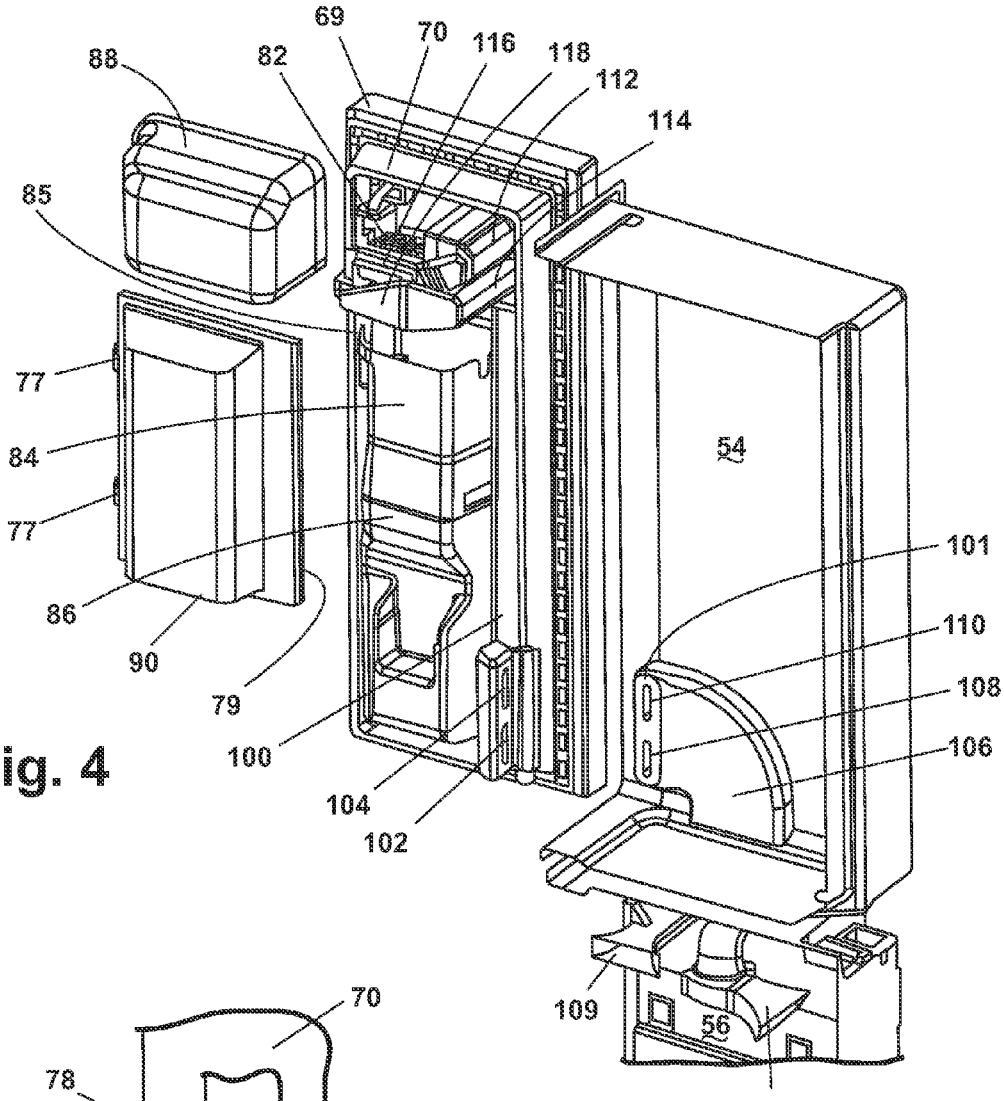
FIG. 4 is a partial perspective view of the embodiment of FIG. 3 with insulated covers moved to show an ice maker, ice cube storage bin ice dispenser mechanism and air passages that can be used with the present invention.
Figure 5:
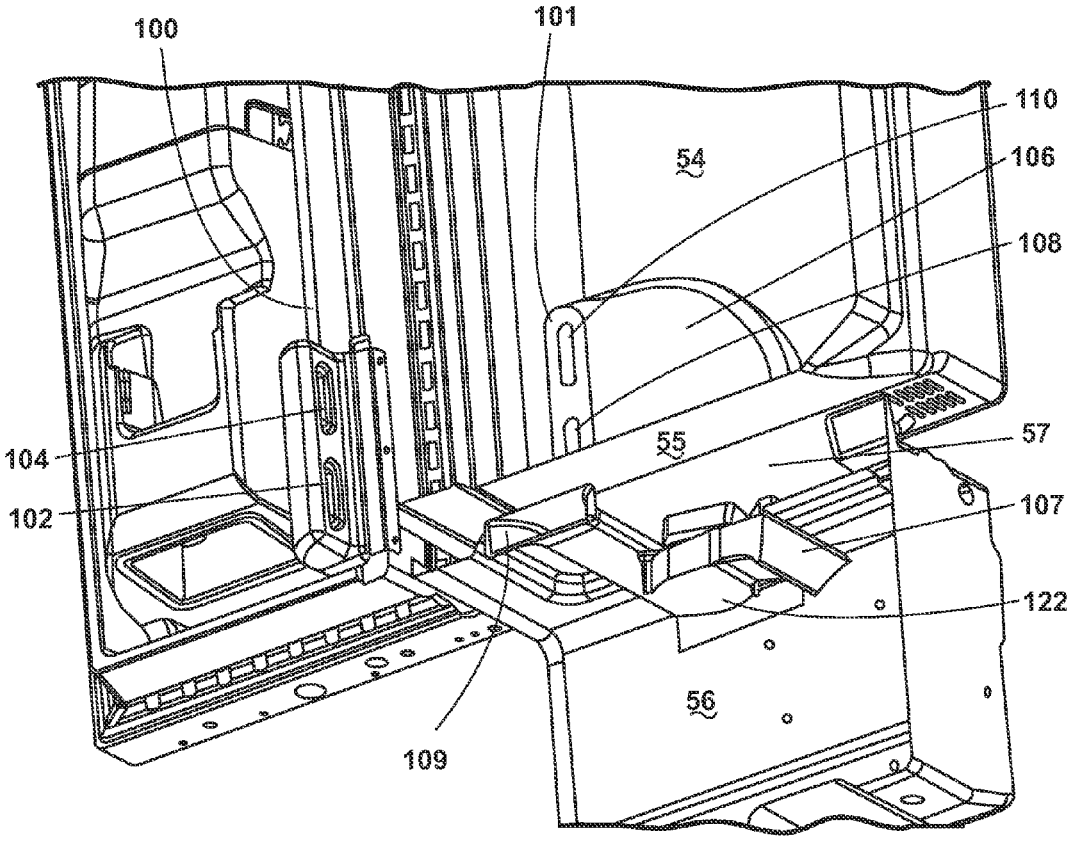
FIG. 5 is a partial perspective view of the embodiment of FIG. 3 showing connection of air passages from the freezer compartment to air passages on the refrigerator compartment door.

Turning to FIG. 3 to FIG. 5, another embodiment of the invention can be seen. An ice maker 82 can be mounted adjacent the top of refrigerator compartment door 69 spaced from inner door panel 70. An ice cube storage bin 84 can be positioned below ice maker 82 and arranged so that ice cubes harvested from ice maker 82 can fall through ice chute 92 (FIGS. 6 and 7) into ice cube storage bin 84. Ice chute 92 can be located between the rear of ice maker 82 and inner door 70 in opening 89 (FIGS. 6 and 7) to direct ice cubes into ice cube storage bin 84. Ice cube storage bin 84 can rest on top of ice dispenser 86. An insulated cover 88 can be provided to substantially enclose ice maker 82. An insulated cover 90 can be provided to substantially enclose ice cube storage bin 84 and ice dispenser 86. Insulated covers 88 and 90 can form sub-compartments that can be maintained below 0° C. to facilitate formation and storage of ice cubes. Insulated cover 88 can include one or more latching surfaces (not shown) arranged to hold cover 88 in place forming a below 0° C. enclosure for ice maker 82 as refrigerator compartment door 69 is opened and closed in use. As described above, insulated cover 88 and insulated cover 90 allow the respective sub-compartments to be maintained at below 0° C. temperatures without upsetting normal above 0° C. temperatures in refrigerator compartment 54.

Figure 4A:
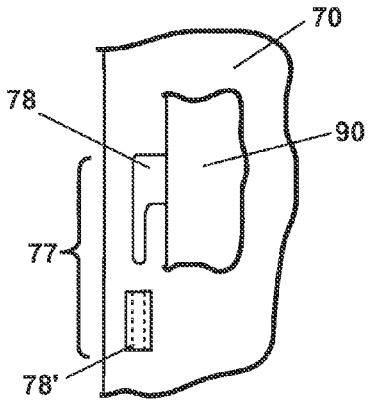
FIG. 4A is a partial detail drawing illustrating hinges for the insulated cover for the ice cube storage bin.

Insulated cover 90 can be pivotally mounted to inner door panel 70 with hinges 77. Hinging insulated cover 90 to inner door panel 70 can allow easy access to ice cube storage bin 84 to, for example, facilitate removal of ice cube storage bin 84 to bulk dispense ice cubes into a cooler or the like. Insulated cover 90 can be arranged so that it can be closed automatically as refrigerator compartment door 69 is closed. Insulated cover 90 can be provided with a gasket 79 on the surface facing inner door panel 70 to seal against a surface of inner door panel 70. Those skilled in the art will understand that gasket 79 can be urethane foam or other suitable resilient gasket material. To facilitate sealing, the surface of inner door panel 70 against which insulated cover 90 closes can be arranged in a plane. A mechanical or magnetic latch (not shown) can be provided to hold insulated cover 90 in a closed position as shown in FIG. 3. Alternately, insulated cover 90 can be provided with a magnetic gasket that can interact with a metal plate or magnet positioned opposite the gasket on the inside surface of inner door 70. The hinges 77 pivotally mounting insulated cover 90 to inner door panel 70 can be two part hinges. Hinges 77 can have one or more pegs 78 carried on insulated cover 90 that insert into mating support holes 78' that can be mounted or formed in inner door panel 70 that can allow removal of the cover 90 without tools, see FIG. 4A. Insulated covers 88 and 90 can be formed of insulating material such as styrobead material or can be formed of double wall plastic sheets with insulating space between the sheets that can be filled with insulating material or gaseous material. Those skilled in the art will understand that the covers 88 and 90 can be transparent, translucent or opaque as desired in order for the ice maker, ice cube storage bin and ice dispenser to be visible or hidden from view when the refrigerator compartment door 69 is opened.

Insulated cover 90 can be omitted if ice cube storage bin 84 is formed of insulating material. In one embodiment, ice cube storage bin 84 can be formed of double wall plastic material with sufficient insulating properties to maintain ice cubes in the bin frozen and sufficiently cold to preclude individual cubes from melting together. Those skilled in the art will readily understand that suitable clear plastic materials such as described above can be used to form an insulated ice cube storage bin 84. Similarly, those skilled in the art will understand that if no insulating cover is provided below 0° C. air flow can be directed into ice cube storage bin 84 in a manner to preclude undesirable leakage to the refrigerator compartment. Below 0° C. air flow for cooling the ice cube storage bin will be described in further detail below.

Ice cube storage bin 84 and ice dispenser 86 can be similar to the ice delivery system disclosed in U.S. Pat. No. 6,082,130, assigned to the assignee of this application and incorporated herein by reference. Co-pending patent applications, US20020155 and US20040124, filed concurrently with this application and incorporated herein by reference, disclose ice makers that can be used as the ice maker 82 in this invention. Those skilled in the art that an ice delivery system such as disclosed in U.S. Pat. No. 6,082,130 can be used in the embodiment shown in FIGS. 3 and 4, or can be provided with an insulating ice cube storage bin as described above, and can be positioned on refrigerator compartment door to cooperate with ice maker 82 and with ice and water dispenser 72 (as shown on FIG. 1). Ice cube storage bin 84 can have a level sensor 91 (see FIG. 16) that can cooperate with notch 85 in the sidewall of ice cube storage bin 84 as described in U.S. Pat. No. 6,082,130. While one approach to level sensing is described in U.S. Pat. No. 6,082,130, those skilled in the art will understand that many ways to determine the level of ice cubes in an ice cube storage bin are known and can be used in place of the optical system described in the above identified patent application. Ice maker 82 and the ice and water dispenser 72 can be provided with water under control of a water valve 95 (see FIG. 16) that can be included in the bottom freezer refrigerator as is well known in the art. Control of water to the ice and water dispenser 72 and ice maker 82 can be a variable flow water system as disclosed in co-pending U.S. patent application Ser. No. 10/861,569 incorporated herein by reference. Water can be supplied to door 69 for ice and water dispenser 72 and for ice maker 82 as is well known in the art.

In this embodiment of the invention below 0° C. air can be supplied to ice maker 82 and ice cube storage bin 84 by an air delivery system that can lead from freezer compartment 56. The air delivery system can include a first air delivery portion 100 that can be positioned along one side of refrigerator compartment door 69 against inner door panel 70. The air delivery system can include a second air delivery portion 106 positioned along a side wall of refrigerator compartment 54 and leading down toward freezer compartment 56. First air delivery portion 100 can include a supply duct 102 and a return duct 104. Those skilled in the art will understand that first air delivery portion 100 can be a dual passage tube having two air passages forming supply duct 102 and return duct 104. First air delivery portion 100 can be formed of thermoformed or injection molded plastic material and can be covered or enclosed with insulating material such as rigid styrobead. Second air delivery portion 106 can similarly comprise a supply duct 108 and a return duct 110. Second air delivery portion 106 can be a dual passage tube formed of plastic material similar to first air delivery portion 100. The faces of first and second air delivery portions 100 and 106 can abut when refrigerator door 69 is closed and can be arranged so that supply ducts 102 and 108 and return ducts 104 and 110 are opposite one another, and can form a continuous passage when refrigerator compartment door 69 is closed. The face of first and second air delivery portions 100 and 106 can include suitable sealing surfaces for the supply and return ducts so that substantially air tight connections can be made when refrigerator compartment door 69 is closed. For example, resilient gasket material 101 such as urethane foam can be provided around the inlets to ducts 108 and 110 to form a substantially air tight seal when refrigerator door 69 is closed and first air delivery portion 100 contacts second delivery portion 106. Those skilled in the art will understand that other gasket arrangements can be provided to seal the first air delivery portion 100 and second delivery portion 106 when refrigerator door 69 is closed. In addition those skilled in the art will understand that first air delivery portion 100 including supply duct 102 and return duct 104 can be formed as part of inner door panel 70. Alternately, first air delivery portion 100 can be provided between inner door panel 70 and the outer panel of refrigerator compartment door 69. Those skilled in the art will also understand that the interface between supply and return ducts 102 and 104 and return ducts 108 and 110 can be formed as a bellows providing an enclosed passage when door 69 is open in lieu of surface seals.

As mentioned above, the first and second air delivery portions 100 and 106 can be insulated to limit heat transfer from the below 0° C. air being delivered to the ice maker 82 and ice cube storage bin 84 to the above 0° C. refrigerator compartment 54. Similarly, insulation can be provided to prevent the refrigerator cabinet 50 from sweating on or near the interface between the first and second air delivery portions 100 and 106. Alternately, those skilled in the art will understand that heaters can be provided for the cabinet adjacent the interface between the first and second air delivery portions 100 and 106 to prevent condensation or frost buildup inside or outside of refrigerator 50 as is well known in the art.

Turning to FIG. 5, an ice maker fan 122 can be mounted at the top wall 57 of freezer compartment 56. Insulation can be provided in the space 55 between the refrigerator compartment 54 and freezer compartment 56 as is well understood in the art. Ice maker fan 122 can be connected to return duct 110 to draw below 0° C. air from freezer compartment 56 to ice maker 82 and ice cube storage bin 84. Ice maker fan 122 can be connected to return duct 110 to draw air from duct 110 and discharge the air into freezer compartment 56 through an outlet 107. Outlet 107 can be aimed to the inlet to the refrigeration system that can include an evaporator compartment along the rear wall of freezer compartment 56 as is well known in the art. As ice maker fan 122 draws air from return duct 110, below 0° C. air from freezer compartment 56 can flow into supply duct 108 through an inlet 109. Those skilled in the art will understand that outlet 107 and inlet 109 can be provided with a suitable grill to preclude items from freezer compartment 56 enter outlet 107 or inlet 109. Below 0° C. air can flow from supply duct 108 to supply duct 102 in the first air delivery portion to ice maker 82 and ice cube storage bin 84. Air from ice maker 82 and ice cube storage bin 84 can flow in return duct 104 to return duct 110, and thence to ice maker fan 122. An advantage of locating ice maker fan 122 in freezer compartment 56 connected to return duct 110 is that power input to the ice maker fan 122 is added to the air stream after it has cooled the ice maker 82 or ice cube storage bin 84. By locating ice maker fan 122 at the discharge of the return duct 110 the air delivery system for the ice maker and ice cube storage bin can operate at slightly less than atmospheric pressure to help seals sealing the air delivery system make positive contact. However, those skilled in the art will understand that ice maker fan 122 can be arranged, and can be used, to force air through supply ducts 108 and 102 rather than drawing air through return ducts 110 and 104 as shown in this embodiment. In addition ice maker fan 122 can be positioned on refrigerator compartment door 69 rather than in freezer compartment 56 as described in conjunction with FIGS. 13 to 15 below. Those skilled in the art will understand that instead of a separate ice maker fan, a conventional evaporator fan plus a suitable air flow control such as a damper can be used to circulate below 0° C. air to the ice maker and ice cube storage bin.

Figure 6:
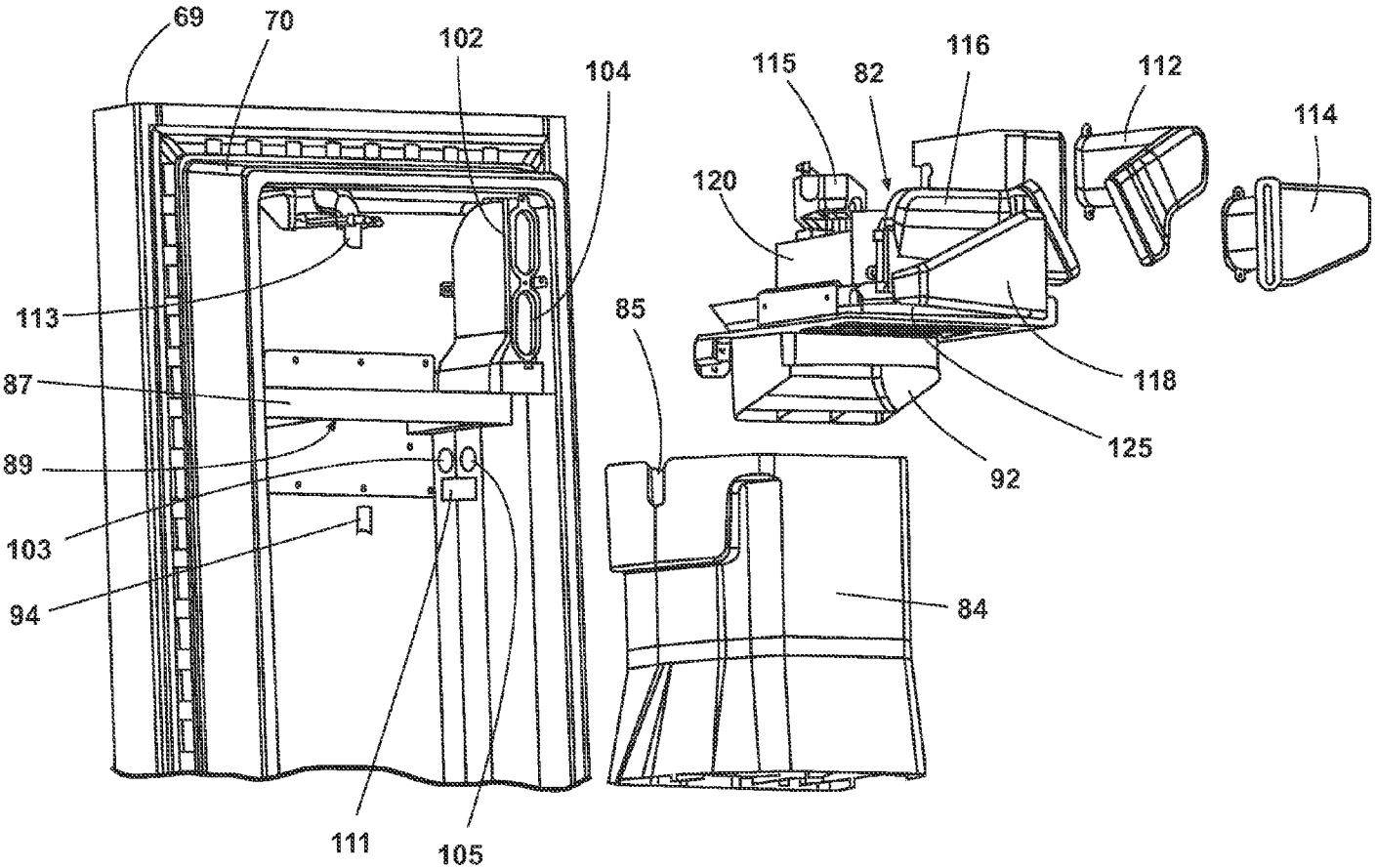
FIG. 6 is a partial exploded view illustrating the ice maker and ice cube storage bin of the embodiment of FIG. 3 spaced from the refrigerator compartment door.
Figure 7:
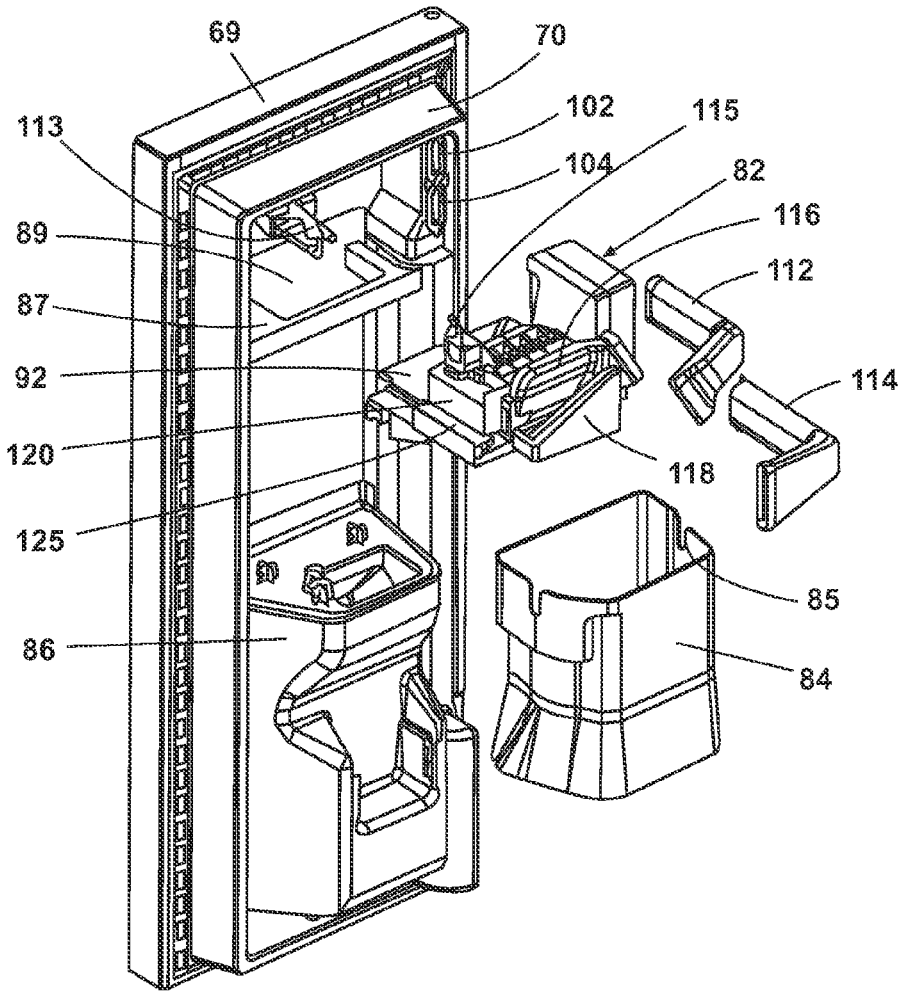
FIG. 7 is another partial exploded view illustrating the ice maker and ice cube storage bin of the embodiment of FIG. 3 spaced from the refrigerator compartment door.
Figure 7A:
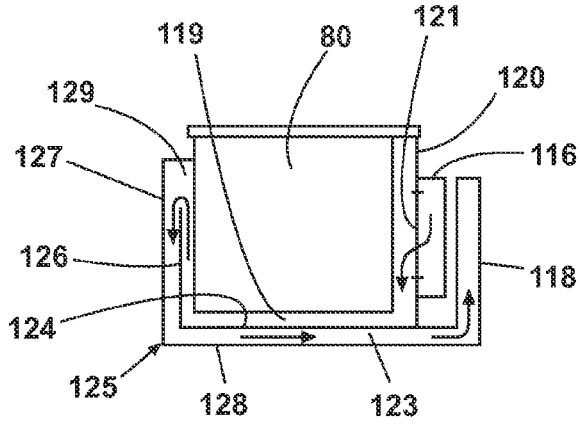
FIG. 7A is a schematic cross section view illustrating the ice maker mold, housing and return shroud of the embodiment of FIG. 3.

Turning to FIGS. 6 and 7, ice maker 82 and ice cube storage bin 84 can be seen spaced from inner door 70 in an exploded view. Ice maker 82 can have an ice chute 92 located along the rear edge of the ice mold 80 arranged to direct ice cubes harvested from the ice mold 80 downward into ice cube storage bin 84. Ice maker fill tube 113 can be provided at the top of inner door 70 arranged to cooperate with water inlet element 115 to fill ice maker 82. Fill tube 113 can be supplied with water by water valve 95 as is well known in the art. The entrance into ice chute 92 substantially fills the space between the ice mold 80 and the inner door 70 when ice maker 82 is mounted spaced from the inner door 70 on support 87. Support 87 can include an opening 89 that can accommodate ice chute 92. Ice maker 82 can be arranged to cause harvested ice cubes to fall off the rear edge of ice mold 80 into ice chute 92 into ice cube storage bin 84 as is well known in the art. As described above, ice cube storage bin 84 can be positioned on dispenser 86 as described in U.S. Pat. No. 6,082,130 fully incorporated in this application by reference. Supply duct 102 and return duct 104 can be connected to ice maker 82 by a supply connector 112 and a return connector 114 that can lead from first air delivery portion 100 to ice maker 82. Ice maker 82 can have a housing 120 enclosing the base of ice mold 80 as described in more detail below in connection with FIGS. 11 and 12. Supply connector 112 can connect to supply inlet 116 connected to housing 120 at housing inlet 121. Return connector 114 can connect return outlet 118. Referring to FIG. 7A in addition to FIGS. 6 and 7, a return shroud 125 can be positioned over bottom wall 124 and the side wall 126 of housing 120 to form a return passage 123. Thus, return passage 123 can be the space between housing 120 and return shroud 125. Side wall 126 of housing 120 can extend part way up the side wall of ice mold 80. Side wall 127 of return shroud 125 can extend further up the side wall of ice mold 80 and thus define an outlet 129 from air passage 119 described below in connection with FIGS. 11 and 12. Return passage 123 can be defined by the space between wall 126 and wall 127 along the side of ice mold 80 and the space between bottom wall 124 and return shroud base 128. As described in this embodiment, return passage 123 can be a generally "L" shaped passage leading from the side of ice maker 82 opposite housing inlet 121 to return outlet 118. Return outlet 118 can connect to return passage 123 at return shroud base 128. Air flow from supply inlet 116 through housing inlet 121, through air passage 119 described below and through return passage 123 to return outlet 118 is shown by arrows in FIG. 7A. While housing 120 and return shroud 125 are described in this embodiment as a single elements those skilled in the art will understand that housing 120 and return shroud 125 can be formed of multiple elements if desired.

Figure 11:
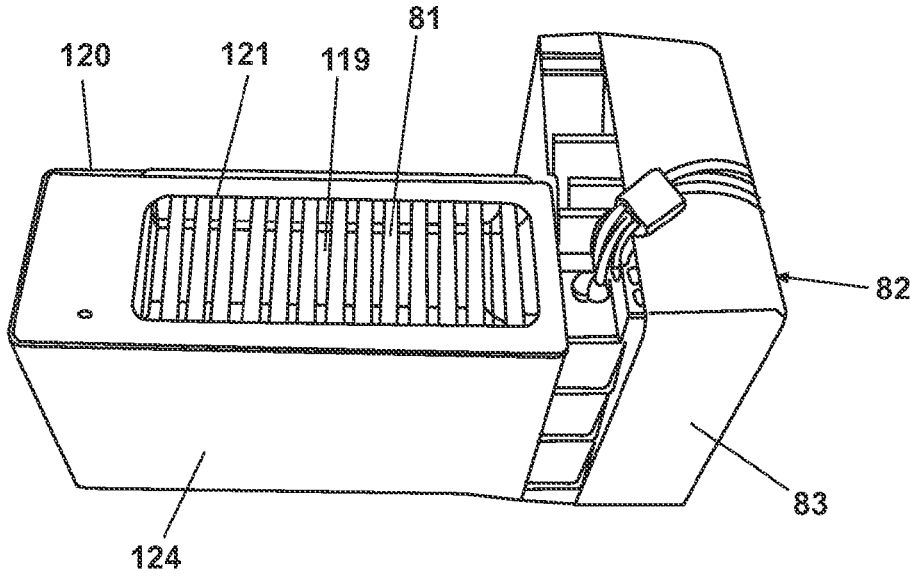
FIG. 11 is a perspective view of an embodiment of an ice maker configured for use according to the present invention.
Figure 12:
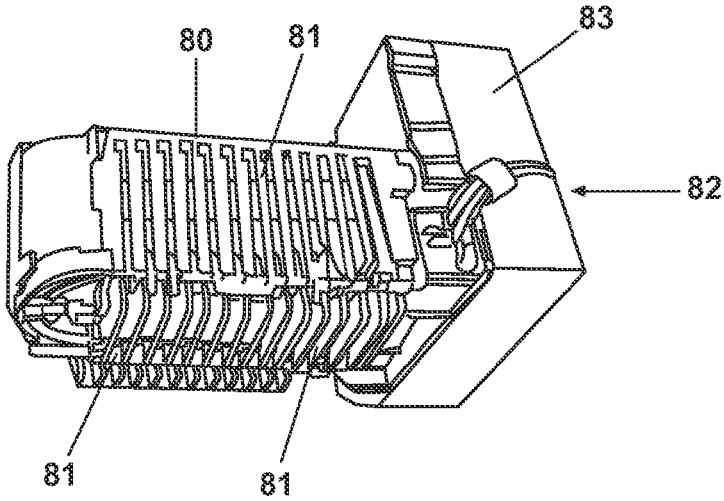
FIG. 12 is a perspective view of the ice maker of FIG. 11 with a housing forming air passages around the ice mold removed.

Turning to FIG. 11 and FIG. 12, ice maker 82 can be seen removed from refrigerator door 69. Ice maker 82 can include a housing 83 for the ice maker control and drive mechanisms as is well known in the art. Extending from housing 83 can be an ice mold 80 having a plurality of cavities (not shown) for holding water to be frozen into ice cubes. Ice mold 80 can be an epoxy coated metal mold formed of aluminum or other material having good thermal conductive properties as is well known in the art. In addition, ice mold 80 can have a plurality of fins 81 extending from the side and bottom walls of the ice mold 80 to facilitate heat transfer from the ice mold during ice cube freezing cycles. While only one side wall is shown in FIGS. 11 and 12, the other side wall (not shown) can also have a plurality of fins 81. A housing 120 can be provided to substantially enclose the bottom and side walls of the ice mold 80. Housing 120 can include a housing inlet opening 121. The supply inlet 116 can be positioned over inlet opening 121. Return shroud 125 can overly the side 126 of housing 120 (shown in FIG. 7A) opposite housing inlet opening 121 and bottom wall 124 as described above. Side 126 of housing 120 can define an outlet opening 129 with return shroud side 127 to allow chilled air to flow into the return passage 123 between return shroud 125 and housing 120. As described above, return shroud base 128 can be spaced from housing bottom wall 124 to define the bottom leg of the return passage leading to return outlet 118. The spaces between adjacent fins 81, ice mold 80 and housing 120 can define an air passage 119 for the below 0° C. air circulating from supply duct 102 to return duct 104. Housing 120, return shroud 125, supply inlet 116 and return outlet 118 can form an air flow circuit around the base of the ice mold 80 to circulate below 0° C. air in air passage 119. The below 0° C. air from supply inlet 116 can enter air passage inlet 121 and flow through air flow passage 119 between fins 81 to the opposite side of the ice mold 80 and through outlet 129 and passage 123 between housing 120 and return shroud 125. Thus, air flow passage 119 and return passage 123 contain below 0° C. air flow to the substantially enclosed space around the bottom and sides of the ice mold 80. Those skilled in the art will understand that housing 120 and ice mold 80 can take other forms to provide a contained air flow path around the base of the ice mold within the scope of the invention. The air flow arrangement according to the invention is substantially different from conventional ice makers having air flowing over the top and sides of the ice maker. Advantages of the air flow arrangement of this invention around the base of the ice mold include enhanced ice production rates resulting from greater heat transfer from the ice mold. Containing the below 0° C. air in air flow passage 119 facilitates temperature control in the refrigerator compartment notwithstanding the below 0° C. air flow to the ice maker 82 and ice cube storage bin 84. Further, cooling the ice mold from the bottom and sides can allow ice to freeze from the bottom up. Freezing ice cubes from the bottom up can help eliminate creation of "ice volcanoes" that can occur when water in the ice mold freezes from the top to the bottom of the mold. When water at the top of an ice mold freezes first when the lower part freezes it expands and can force a channel of water to either the upper or lower surface, possibly damaging the ice mold. Those skilled in the art will understand that below 0° C. air can be delivered to an ice maker without containing the chilled air to the base of the ice mold if the design of the ice maker renders that impractical. When the below 0° C. air is not contained to the base of the ice mold, as in this embodiment, insulating covers such as 88 and 90 can be modified to maintain acceptable above 0° C. temperatures in the refrigerator compartment.

Returning to FIG. 6, supply duct 102 and return duct 104 can have an opening adjacent the ice cube storage bin 84 to provide a flow of below 0° C. air for the ice cube storage bin 84. Supply duct 102 can have a port 103 and return duct 104 can have a port 105 positioned below ice maker 82 and arranged to discharge and collect below 0° C. air from ice cube storage bin 84. A damper 111 can be provided to regulate the flow of below 0° C. air into and out of the ice cube storage bin 84. To provide satisfactory ice cube storage it can be desirable to control the temperature in the ice cube storage bin to below 0° C. However, applicants have found that it is not necessary to maintain the ice cube storage bin as cold as freezer compartment 56 for satisfactory ice cube storage. Damper 111 can be arranged for manual adjustment by a user, or can be operated by a feedback control (not shown) including a temperature sensor, described below, for the ice cube storage bin. Feedback controls capable of operating damper 111 based on temperature sensed by a temperature sensor are well known in the art. Damper 111 can be arranged to have two positions, open and closed, or can be arranged to be infinitely adjustable. In either case damper 111 can be operated by a suitable feedback control as will be readily understood by those skilled in the art. Another alternative can be to size the ports 103 and 105 so that no damper is required over the normal range of operating conditions. With this alternative, ports 103 and 105 can be sized to provide a sufficient, but not excessive amount of below 0° C. air to maintain satisfactory temperatures in the ice cube storage bin 84. Those skilled in the art will understand that other means can be provided to cool ice cube storage bin 84 including thermoelectric cooling, a separate chilled air supply/return or heat pipes leading to a source of below 0° C. temperatures.

A temperature sensor 94 can be provided for the ice cube storage bin 84 as can be seen in FIG. 6. Temperature sensor 94 can be positioned on inner door 70 adjacent ice cube storage bin 84 when it is installed on refrigerator compartment door 69. Temperature sensor 94 can be a thermistor or similar sensor conventionally used to control refrigerator and freezer compartment temperatures and can be connected to ice maker control 138 as described in more detail below in connection with FIG. 16. While temperature sensor 94 is described herein as a thermistor those skilled in the art will readily understand that temperature sensor 94 can be another temperature sensitive device such as a thermocouple or bi-metal thermostat.

Alternately, only a supply duct port 103 can be provided. After cooling the ice cube storage bin 84 the below 0° C. air can be allowed to enter the refrigerator compartment 54 and return to the refrigeration system with air in the refrigerator compartment. In this embodiment a damper 111 and feedback control as described above can be provided to control the ice cube storage bin temperature.

Figure 8:
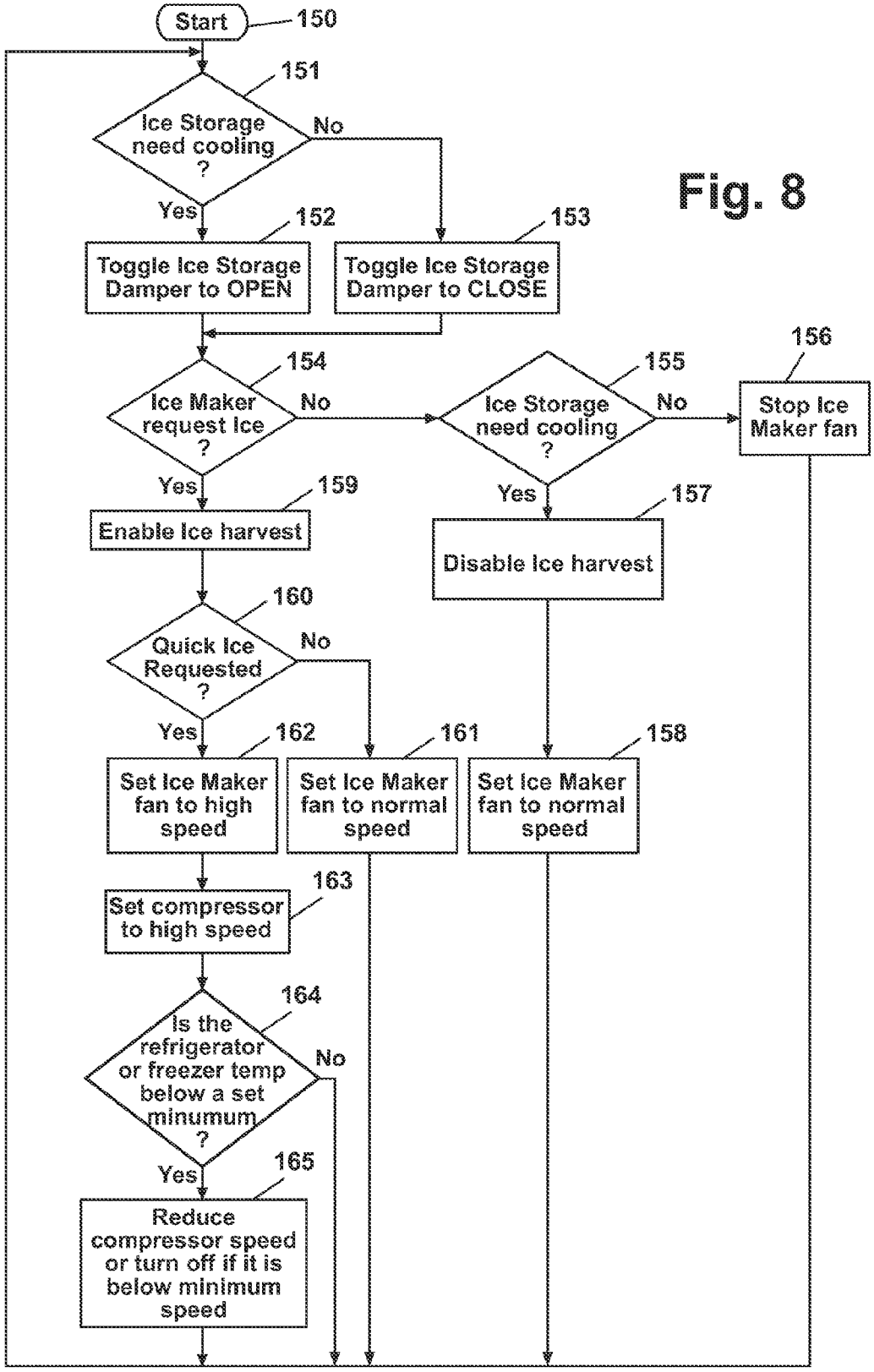
FIG. 8 is a flow chart illustrating the operation of one embodiment of the invention.
Figure 16:
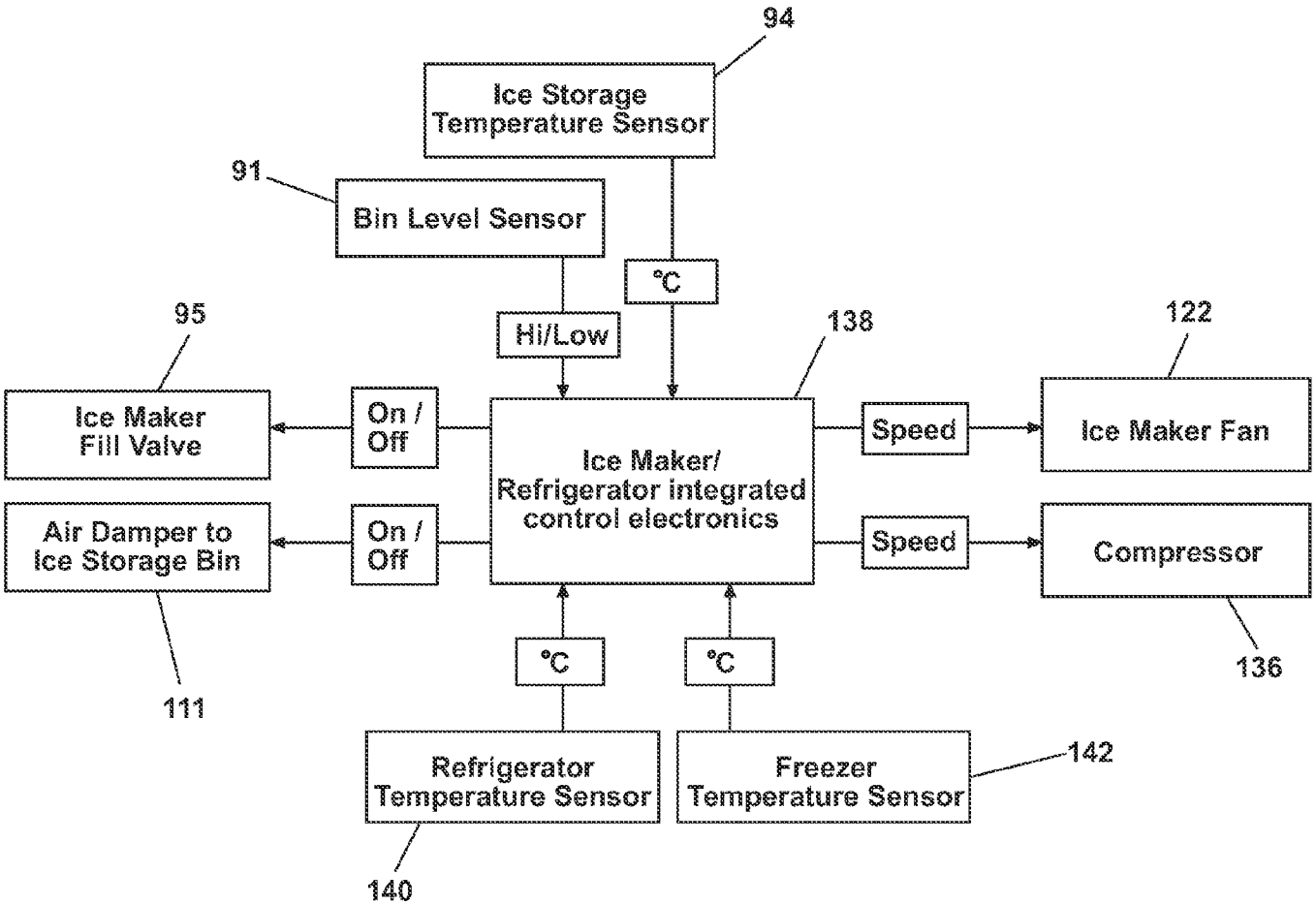
FIG. 16 is a block diagram of a control circuit that can be used with the embodiment of the invention described the flow chart in FIG. 8.

As mentioned above, the ice maker according to the invention can provide enhanced ice production. In one embodiment of the ice maker according to the invention the ice maker control 138 can be arranged to provide enhanced ("quick ice") and normal ice production rates. Ice maker control 138 can be a control dedicated to operation of the ice maker and ice dispenser, or can be a portion of an integrated controller for the bottom freezer refrigerator 50 as will be readily understood by those skilled in the art. In order to provide "quick ice" operation, ice maker fan 122 can be a multiple speed fan having normal and high speed capability. Turning to FIG. 8 and FIG. 16 a flow chart and control circuit for ice maker 82 and control 138 arranged to provide a "quick ice" feature can be seen. Beginning with Start, 150, the ice maker control 138 can determine whether the ice cube storage bin requires cooling, step 151. If cooling is required the feedback control (not shown) can operate damper 111 to open supply duct port 103 and return duct port 104, step 152. If cooling is not required the feedback control can operate damper 111 to close supply duct port 103 and return duct port 104, step 153. Next ice maker control 138 can determine if the ice maker 82 is requested to make ice, step 154, for example by an ice cube storage bin level sensor 91 as mentioned above. If ice is not required the ice maker control 138 can determine if the ice cube storage bin 84 requires cooling, step 155. If the ice cube storage bin 84 does not require cooling, as determined by a temperature sensor 94 for ice cube storage bin 84 as described above, the ice maker control 138 can stop the ice maker fan 122, step 156. If the ice cube storage bin 84 requires cooling but no ice is requested the ice harvest cycle for the ice maker 82 is disabled, step 157 and the ice maker fan 122 is set for normal speed operation, step 158.

If ice maker control 138 determines ice is requested in step 154, an ice maker harvest cycle can be initiated, step 159. Ice maker operation including filling the ice mold with water, ice cube formation and ice harvesting are all well known in the art. One example of automatic ice maker operation to harvest ice cubes can be found in U.S. Pat. No. 6,082,130 referred to above and incorporated herein by reference. After a harvest cycle is initiated ice maker control 138 determines if enhanced ice production, or "quick ice" has been selected by the user, step 160. Those skilled in the art will understand that "quick ice" can be a user selection that can be included on a user interface 73 that can be positioned on the face of the refrigerator compartment door 69 adjacent the ice and water dispenser 72, see FIG. 1. If "quick ice" is not selected the ice maker control 138 can continue to operate ice maker fan 122 at the normal speed, step 161. If "quick ice" is selected by the user, the ice maker fan 122 can be set to operate at high speed, step 162, and the compressor 136 can be set to operate at high speed, step 163 by the ice maker control 138. When ice maker fan 122 and the compressor are set to operate at high speed, steps 162 and 163, the ice maker control 138 can be arranged to determine if the temperature in the refrigerator compartment or freezer compartment is below a predetermined minimum temperature, step 164. Ice maker control 138 can be connected to the refrigerator control system and the respective temperature controllers 140 and 142 to determine whether the refrigerator or freezer compartment temperatures are below predetermined temperatures. If refrigerator and freezer compartment temperatures are not below the predetermined minimum temperatures the ice maker control 138 can allow the compressor 136 and ice maker fan 122 to continue to operate at high speed. If refrigerator or freezer compartment temperatures are below the predetermined minimum temperatures as measured by the temperature sensors 140 and 142 for the respective compartments the ice maker control 138 can reduce the compressor speed, step 165. If the compressor 136 is then running at a predetermined minimum speed, the ice maker control 138 can stop the compressor operation. The ice maker control 138 can be arranged to cycle through the steps described above every one-half to two minutes. Those skilled in the art will understand that the sampling rate can be faster or slower depending on ambient temperature, door openings and the like.

Figure 9:
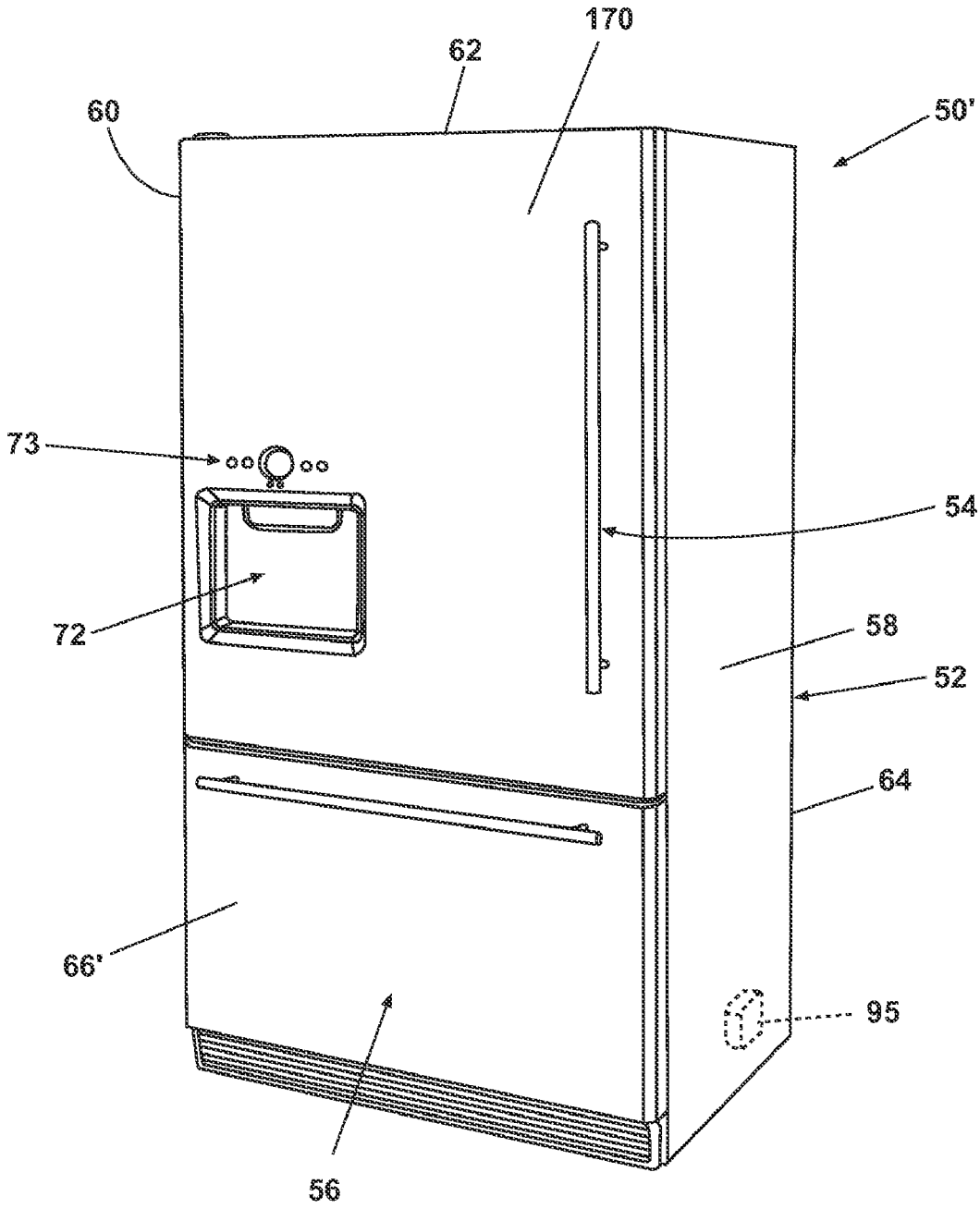
FIG. 9 is a perspective view of another embodiment of bottom freezer refrigerator including an ice maker and ice dispenser according to the present invention.
Figure 10:
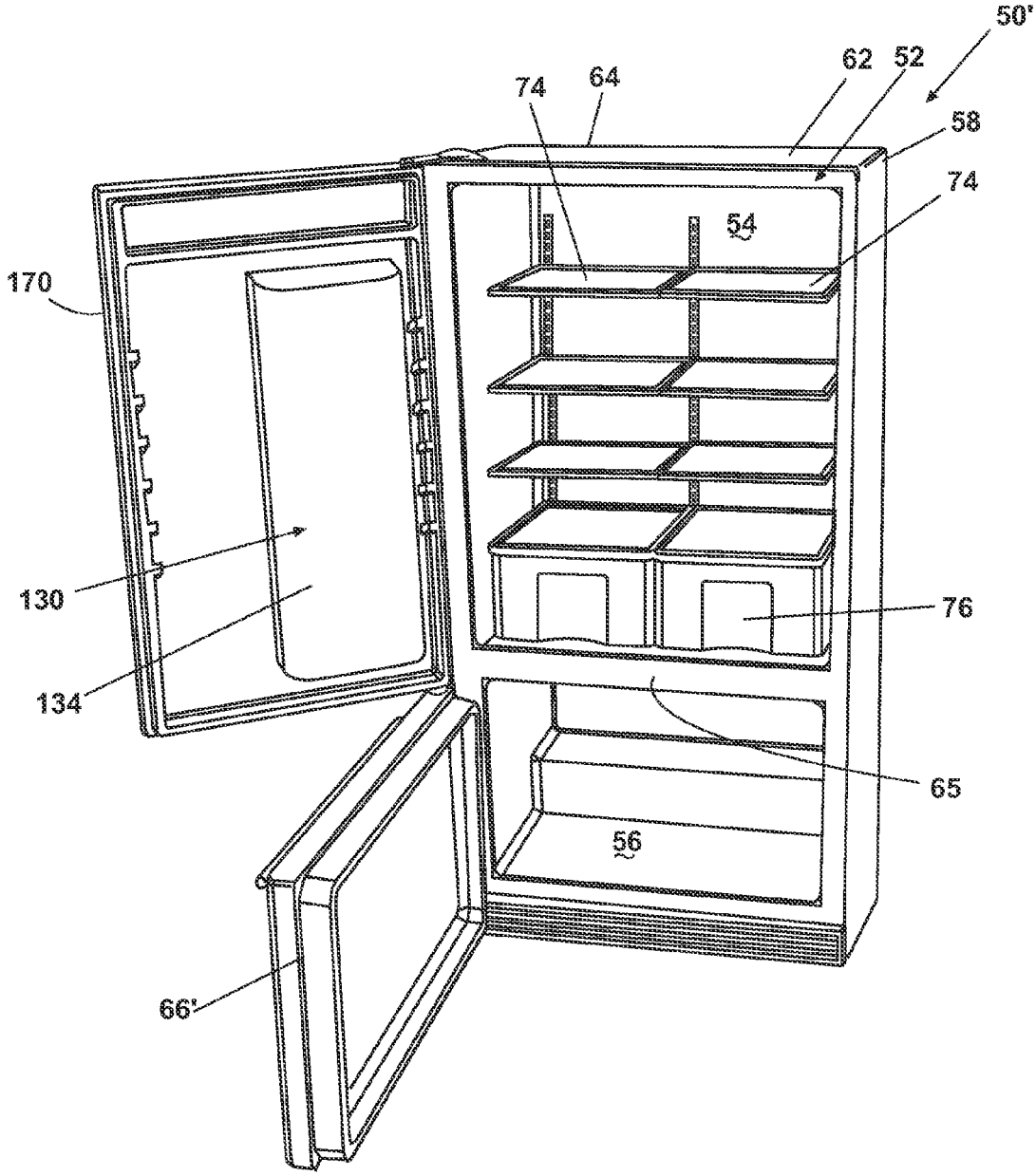
FIG. 10 is a perspective view of the bottom freezer refrigerator embodiment of FIG. 9 with the refrigerator compartment and freezer compartment doors open.

Turning to FIG. 9 and FIG. 10, another embodiment of bottom freezer refrigerator having an ice maker and dispenser apparatus according to the invention can be seen. Bottom freezer refrigerator 50' can have a cabinet 52 including a refrigerator compartment 54 maintained at above 0° C. temperatures and a freezer compartment 56 maintained at below 0° C. temperatures. Freezer compartment 56 is positioned in the bottom of compartment 52 and refrigerator compartment 54 is positioned above freezer compartment 56. In the embodiment of FIG. 9 and FIG. 10, bottom freezer refrigerator 50' can have refrigerator compartment door 170 to close the refrigerator compartment 54. Bottom freezer refrigerator 50' is generally the same as bottom freezer refrigerator 50 as shown in FIG. 1 and FIG. 2 with the exception of the refrigerator compartment door 170. Accordingly, the same reference numerals are used for the embodiment of FIG. 9 and FIG. 10 with the exception of the refrigerator compartment doors. While no door handles are shown on refrigerator compartment door 170 and freezer compartment door 66' those skilled in the art will readily understand that handles for the doors can be provided if desired as is well known in the art. Refrigerator compartment 54 can include a plurality of shelves 74 that can be fixed or can be adjustable as shown in FIG. 10. One or more bins 76 can be provide in refrigerator compartment 54 for storing food items such as meats, vegetables, fruit and other food items that can benefit from storage in a closed receptacle that can be temperature and/or humidity controlled as is well known in the art. Likewise, one or more shelves or baskets (not shown) can be provided in freezer compartment 56, again as is well known in the art.

Refrigerator compartment door 170 can include an ice and water dispenser 72 positioned on the face of the door. Ice and water dispenser 72 can be positioned on refrigerator compartment door 170 at a convenient height for user access as is well known in the art. As in the embodiment of FIG. 1 and FIG. 2 a user interface 73 can be positioned adjacent ice and water dispenser 72 for users to select ice and water dispensing alternatives such as "quick ice" described above, and other refrigerator freezer operation parameters such as described in co-pending U.S. patent application Ser. No. 10/861,203 incorporated herein by reference. Ice making and dispensing apparatus 130 can be positioned on the inside surface of refrigerator compartment 69 and can include an insulated enclosure 134. Ice making and dispensing apparatus 130 can be positioned to feed ice cubes to the dispenser 72 as is well known in the art. As in the embodiment of FIG. 1 and FIG. 2 an air duct (not shown) can be provided leading from a source of below 0° C. air to the insulated enclosure 134 to facilitate formation and storing ice cubes in refrigerated space, refrigerated compartment 54, that is maintained above 0° C. Insulated enclosure 134 in effect forms a sub-compartment that can be maintained below 0° C. to facilitate formation and storage of ice cubes. The ice maker, ice cube storage bin and ice dispenser of the embodiment of FIGS. 3 through 7 can be used in the bottom freezer refrigerator in the embodiment of FIGS. 9 and 10 as will be understood by those skilled in the art. Those skilled in the art will understand that in the embodiment of FIGS. 9 and 10 that the ice cube storage bin and dispenser could be arranged side by side rather than vertically if desired.

Figure 13:
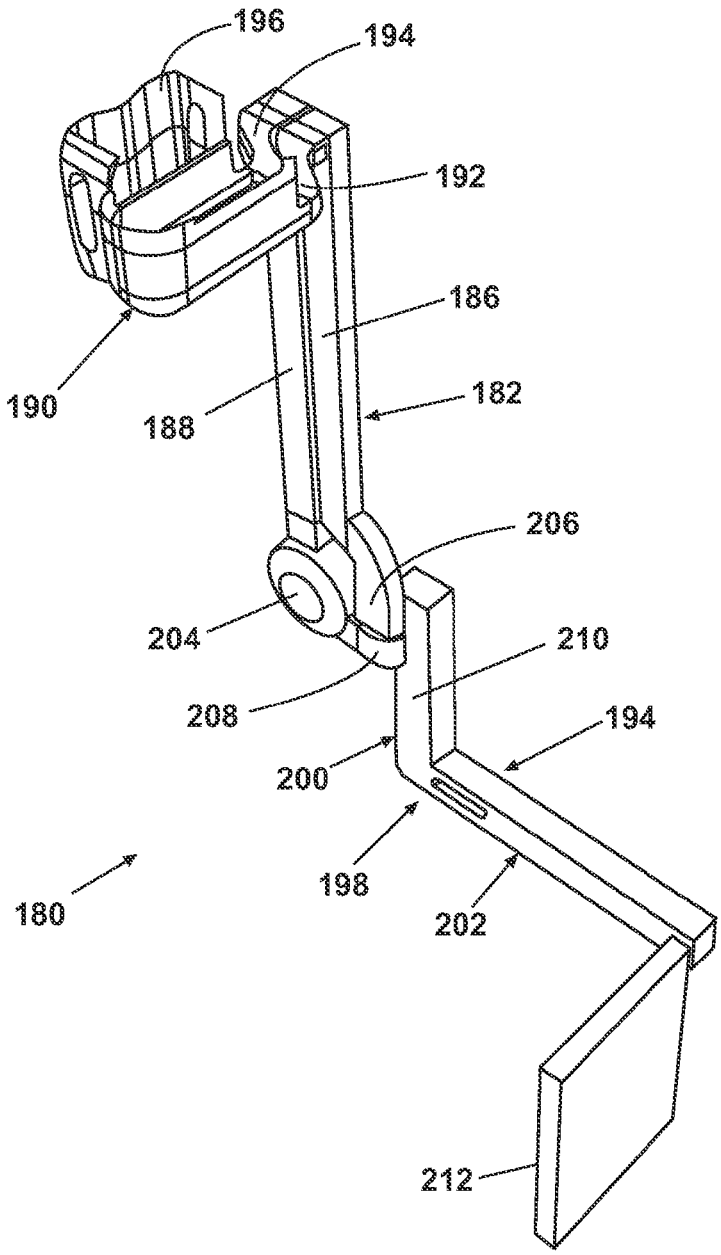
FIG. 13 is a perspective view of another embodiment of an ice maker air delivery system according to the invention removed from a bottom freezer refrigerator.
Figure 14:
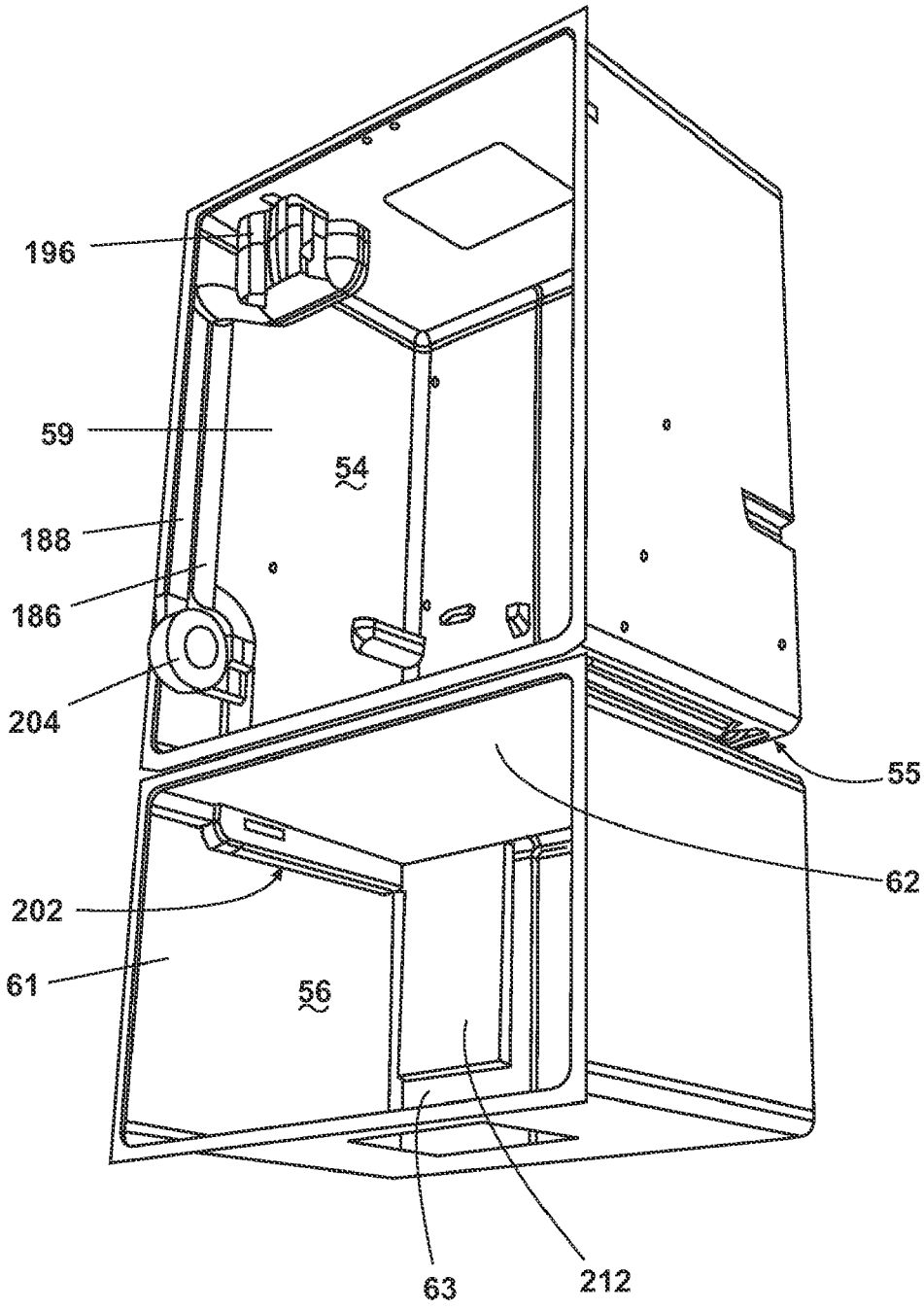
FIG. 14 is a partial front perspective view of a bottom freezer refrigerator liner with an air delivery system as shown in FIG. 13 installed.
Figure 15:
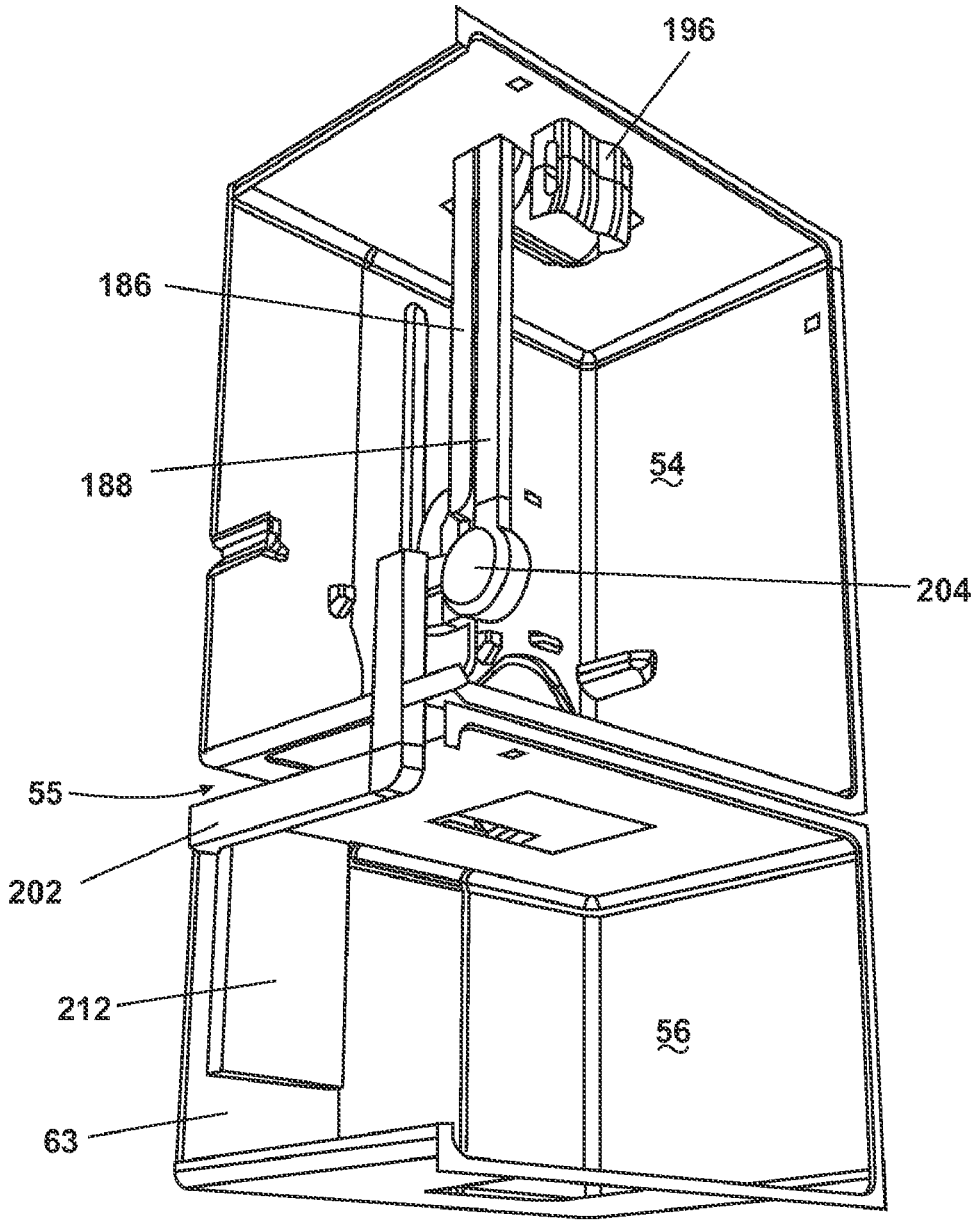
FIG. 15 is a partial front perspective view of a bottom freezer refrigerator with an air delivery system as shown in FIG. 13 installed with portions of the refrigerator compartment and freezer compartment liners removed.

Turning to FIGS. 13 to 15 an alternate embodiment of an ice maker air delivery system can be seen removed from the bottom freezer refrigerator. Air delivery system 180 can include a first air delivery portion 182 that can be mounted to or in a refrigerator compartment door (not shown) that can be a door like that shown in the embodiment of FIG. 1 or FIG. 9. Air delivery system 180 can include a second air delivery portion 184 that can be mounted to or in the side walls 59 and 61 of the refrigerator compartment 54 and freezer compartment 56 as described above. First air delivery portion 182 of the air delivery system 180 can include a supply duct 186 and a return duct 188. First air delivery portion 182 can include a supply duct connector 192 leading from supply duct 186 to an ice mold cooling cavity 190. First air delivery portion 182 can also include a return duct connector 194 leading from the ice mold cooling cavity 190 to return duct 188. An ice maker 82 (not shown) similar to the ice maker in the embodiment of FIGS. 3 to 7 can be positioned on top of ice mold cooling cavity 190 with the ice mold 80 (not shown) extending down into the ice mold cooling cavity 190. Those skilled in the art will understand that the ice maker and ice mold can be arranged to close off the open top of the ice mold cooling cavity to enclose the base of ice mold (not shown) and contain the flow of below 0° C. air around the base of the ice mold as described above in connection with FIGS. 11 and 12. An ice chute 196 can be positioned at the rear side of ice mold cooling cavity 190 to direct ice cubes harvested from ice maker (not shown) down into an ice cube storage bin (not shown) that can be arranged similar to the embodiment shown in FIGS. 3 to 7. Second air delivery portion 184 can include a cabinet duct 198 having a first cabinet duct leg 200 that can be positioned along refrigerator compartment side wall 59 and can extend through insulation space 55 into freezer compartment 56. Duct 198 can have a second cabinet duct leg 202 that can extend along freezer compartment side wall 61 adjacent freezer compartment top wall 62 toward freezer compartment rear wall 63. Duct 198 can include a supply duct and a return duct as described above in connection with FIGS. 3 to 5.

In the embodiment of the air delivery system shown in FIGS. 13 to 15 an ice maker fan 204 can be positioned on the refrigerator compartment door, not shown. Ice maker fan 204 can be connected to return duct 188 and arranged to draw below 0° C. air through the air delivery system 180 through the supply ducts and ice maker 190 as described above. First air delivery portion 182 can be connected to second air delivery portion 184 when the refrigerator compartment door (not shown) is closed by supply interface 206 and return interface 208. The air delivery system is shown in FIGS. 13 to 15 in the refrigerator compartment door closed position. Supply interface 206 can lead from supply duct 186 to first cabinet duct leg 200. Similarly, return interface 208 can lead from return duct 188 to first cabinet duct leg 200. First cabinet duct leg 200 can have openings (not shown) in surface 210 that communicate with the supply duct and return duct in first cabinet duct leg 200. Supply interface 206 and return interface 208 can have matching openings (not shown) in the face 210 adjoining first cabinet duct leg 200 that can allow below 0° C. air to flow through the ice maker air delivery system 180 in operation. As described above in connection with FIGS. 3 to 5, supply and return interfaces 206 and 208, and first cabinet duct leg 200 can have a gasket or sealing surface (not visible in FIGS. 13 to 15) for the openings to facilitate effective sealing of the first air delivery portion 182 to the second air delivery portion 184 in operation. Second air delivery portion 184 can extend to the rear of freezer compartment 56 and can connect to an evaporator cover 212 that can be positioned along the rear wall 63 of the freezer compartment 56. Below 0° C. air can be drawn out the evaporator compartment (not shown) behind evaporator cover 212 and through the air delivery system 180 to the ice maker (not shown) and ice cube storage bin (not shown).

While the invention has been specifically described in connection with certain specific embodiments thereof, it is to be understood that this is by way of illustration and not of limitation, and the scope of the appended claims should be construed as broadly as the prior art will permit.

We claim:

1. An ice maker and dispenser for a bottom freezer refrigerator comprising:

a freezer compartment maintained at a temperature below 0° C.;

a refrigerator compartment positioned above the freezer compartment maintained at a temperature above 0° C.;

an insulated freezer compartment door;

an insulated refrigerator compartment door liner;

a refrigeration system for cooling the freezer compartment and the refrigerator compartment;

an ice maker positioned in an insulated ice maker sub-compartment on the refrigerator compartment door liner;

an insulated ice cube storage bin positioned on the refrigerator door liner below the ice maker;

an ice dispenser positioned on the refrigerator door liner below the ice cube storage bin for dispensing ice pieces from the ice cube storage bin through the refrigerator door liner;

an air delivery system leading to the ice maker and ice cube storage bin from a source of below 0° C. air for supplying air cooled to below 0° C. to the ice maker and to the storage bin; and wherein the ice cube storage bin is positioned in an insulated ice cube storage bin sub-compartment, the ice cube storage bin sub-compartment comprises a space enclosed by an insulated cover pivotally mounted on the refrigerator door liner, and wherein the insulated cover includes a gasket for forming a seal to the refrigerator door liner.

2. The ice maker and dispenser for the bottom freezer refrigerator according to claim 1, wherein the insulated cover is transparent.

3. The ice maker and dispenser for the bottom freezer refrigerator according co claim 1, wherein the interface between the insulated cover and the refrigerator door liner is substantially planar.

4. The ice maker and dispenser for the bottom freezer refrigerator according to claim 1, wherein the insulated cover is pivotally mounted on the refrigerator inner door liner by a plurality of pegs carried by the insulated cover, and wherein the cover is removably mounted on the refrigerator inner door without tools.

5. The ice maker and dispenser for the bottom freezer refrigerator according to claim 1, wherein the insulated cover is pivotably mounted on the refrigerator door liner such that the insulated cover is automatically closed when the refrigerator door is closed.

6. The ice maker and dispenser for the bottom freezer refrigerator according to claim 1, wherein the insulated cover encloses the ice maker.

7. The ice maker and dispenser for the bottom freezer refrigerator according to claim 1, wherein the insulated cover is opaque.

8. The ice maker and dispenser for the bottom freezer refrigerator according to claim 1 wherein the insulated cover is held in a closed position by a latch.

9. The ice maker and dispenser for the bottom freezer refrigerator according to claim 8 wherein the latch is a magnetic latch.

10. The ice maker and dispenser for the bottom freezer refrigerator according to claim 8 wherein the latch is a mechanical larch.

11. The ice maker and dispenser for the bottom freezer refrigerator according to claim 1 wherein the gasket is magnetic.

12. An ice maker and dispenser for a bottom freezer refrigerator comprising:

a freezer compartment maintained at a temperature below 0° C.;

a refrigerator compartment positioned above the freezer compartment maintained at a temperature above 0° C.;

an insulated freezer compartment door.

an insulated refrigerator compartment door;

a refrigeration system for cooling the freezer compartment and the refrigerator compartment;

an ice maker positioned in an insulated ice maker sub-compartment on the refrigerator compartment door and having a mold for forming ice pieces, the mold having side walls and a bottom wall and the ice maker further comprises a housing enclosing the side walls and bottom wall of the ice mold forming an air flow passage around the ice maker mold;

an ice cube storage bin positioned on the refrigerator door below the ice maker;

an ice dispenser positioned on the refrigerator door below the ice cube storage bin for dispensing ice pieces from the ice cube storage bin through the refrigerator door;

an air delivery system including a supply duct and a return duct leading to the ice maker and ice cube storage bin from a source of below 0° C. air for supplying air cooled to below 0° C. to the ice maker and to the ice storage bin;

an ice maker fan connected to the air delivery system wherein operation of the ice maker fan causes air from the source of below 0° C. air to flow to the ice maker and to the ice storage bin; and wherein the supply duct and the return duct include a first air delivery portion carried on the refrigerator door and a second air delivery portion leading from the bottom of the refrigerator door to the source of below 0° C. air.

13. The ice maker and dispenser for the bottom freezer refrigerator according to claim 12, wherein the first air delivery portion of the supply duct and the return duct includes a vertical portion extending from the bottom of the refrigerator door to the ice maker sub compartment.

14. The ice maker and dispenser for the bottom freezer refrigerator according to claim 12, wherein the housing includes side walls and a bottom wall spaced from the side walls and bottom wall of the ice mold and the air flow passage comprises the space between the ice mold and the housing.

15. The ice maker and dispenser for the bottom freezer refrigerator according to claim 12, wherein the housing substantially contains the below 0° C. air.

16. The ice maker and dispenser for the bottom freezer refrigerator according to claim 14, wherein the ice maker mold includes a plurality of fins extending from the side walls and bottom wall of the ice mold and extending substantially to the side walls and bottom wall of the housing.

17. The ice maker and dispenser for the bottom freezer refrigerator according to claim 16, wherein the fins are arranged to form an elongated air flow passage around the bottom and sides of the ice maker mold.

18. The ice maker and dispenser for the bottom freezer refrigerator according to claim 12 further including a supply connector leading from an outlet in the top of the vertical portion of the supply duct to the air flow passage around the ice maker mold.

19. The ice maker and dispenser for the bottom freezer refrigerator according to claim 18, further including a return connector leading from the air flow passage around the ice maker mold to the return duct.

20. The ice maker and dispenser for the bottom freezer refrigerator according to claim 13, further including an inlet port in the vertical portion of the supply duct adjacent the ice cube storage bin and an outlet port in the vertical portion of the return duct adjacent the ice storage bin.

21. The ice maker and dispenser for the bottom freezer refrigerator according to claim 20, further including an ice cube storage bin damper to control air flow through one or both of the inlet port and the outlet port.

22. The ice maker and dispenser for the bottom freezer refrigerator according to claim 21, further including an ice cube storage bin temperature sensor adjacent the ice cube storage bin and a control connected to the ice cube storage bin temperature sensor and to the ice cube storage bin damper, wherein the control to regulates the position of the ice cube storage bin damper in response to the temperature sensed by the ice cube storage bin temperature sensor.

23. The ice maker and dispenser for the bottom freezer refrigerator according to claim 22, wherein the ice cube storage bin damper is a two position damper arranged to open or close one or both of the inlet and outlet ports.

24. The ice maker and dispenser for the bottom freezer refrigerator according to claim 22, wherein the ice cube storage bin damper is continuously adjustable wherein the control regulates the position of the ice cube storage bin damper in response to the temperature sensed by the ice cube storage bin temperature sensor.

25. The ice maker and dispenser for the bottom freezer refrigerator according to claim 20, wherein the inlet port and the outlet port are sized to maintain the temperature of the ice cube storage bin below 0° C.

26. The ice maker and dispenser for the bottom freezer refrigerator according to claim 13, further including an inlet port in the vertical portion of the supply duct adjacent the ice cube storage bin and a ice cube storage bin damper to control air flow through the inlet port.

27. The ice maker and dispenser for the bottom freezer refrigerator according to claims 26, wherein air flowing through the inlet port to cool the ice cube storage bin flows to the refrigerator compartment after cooling the ice storage bin.

28. An ice maker and dispenser for a bottom freezer refrigerator comprising:

a freezer compartment maintained at a temperature below 0° C.;

a freezer compartment positioned above the freezer compartment maintained at a temperature above 0° C.;

an insulated freezer compartment door;

an insulated refrigerator compartment door;

a refrigerator system for coding the freezer compartment and the refrigerator compartment including a compressor;

an automatic ice maker positioned on the refrigerator compartment door;

an ice cube storage bin positioned on the refrigerator door below the ice maker;

an ice cube storage bin temperature sensor adjacent the ice cube storage bin;

an ice dispenser positioned on the refrigerator door below the ice cube storage bin for dispensing ice pieces from the ice cube storage bin through the refrigerator door;

an air delivery system leading to the ice maker and ice cube storage bin from a source of below 0° C. air for supplying air cooled to below 0° C. to the ice maker and ice cube storage bin and having at least one port adjacent the ice storage bin;

an ice cube storage bin damper to control air flow through the at least one port;

an ice maker fan connected to the air delivery system wherein operation of the ice maker fan causes air from the source of below 0° C. air to flow to the ice maker and to the ice storage bin; and an ice maker control for the automatic ice maker, the ice maker fan, and the ice cube storage bin damper arranged to:

open the ice cube storage bin damper and operate the ice maker fan when the ice cube storage bin temperature sensor indicates the ice cube storage bin needs cooling; and operate the ice maker fan when the ice maker is producing ice.

29. The ice maker and dispenser for the bottom freezer refrigerator according to claim 28, wherein the control further includes a quick ice mode of operation, the compressor is further arranged to operate at multiple speeds including high speed, and the ice maker fan is further arranged to operate at least a high speed and a normal speed, wherein when the quick ice mode is selected the ice maker control is arranged to operate the compressor at high speed and the ice maker fan at high speed.

30. The ice maker and dispenser for the bottom freezer refrigerator according to claim 29, further including a freezer compartment temperature controller and a refrigerator compartment temperature controller connected to the ice maker control, and wherein the ice maker control is arranged to reduce the compressor speed when the freezer compartment temperature control or the refrigerator compartment control sense a temperature below a predetermined temperature in the refrigerator compartment on the freezer compartment.

31. The ice maker and dispenser for the bottom freezer refrigerator according to claim 29, wherein the ice maker control is arranged to operate the ice maker fan at normal speed when the quick ice mode of operation is not selected.

32. The ice maker and dispenser for the bottom freezer refrigerator according to claim 29, wherein the ice maker control is arranged to turn off the compressor in the event the freezer compartment temperature control or the refrigerator compartment control sense a temperature below a predetermined temperature in either the refrigerator or compartment or the freezer compartment and the compressor is operating at the lowest speed.

33. The ice maker and dispenser for the bottom freezer refrigerator according to claim 28, wherein the ice maker control is arranged to stop the ice maker fan when the ice cube storage bin temperature sensor indicates the ice cube storage bin does not need cooling.

34. A method of producing and storing ice pieces in a bottom freezer refrigerator having a freezer compartment maintained at a temperature below 0° C.;

a refrigerator compartment positioned above the freezer compartment maintained at a temperature above 0° C.;

an insulated refrigerator compartment door, a refrigeration system including an evaporator and an evaporator fan for cooling the freezer compartment and the refrigerator compartment having a compressor;

an ice maker positioned on the refrigerator door;

an ice cube storage bin positioned on the refrigerator door below the ice maker;

an air delivery system leading to the ice maker and ice cube storage bin from a source of below 0° C. air for supplying air cooled to below 0° C. to the ice maker and ice cube storage bin and having at least one port adjacent the ice bin and having an ice bin damper for selectively opening and closing the at least one port; and an ice maker fan connected to the air delivery system wherein operation of the ice maker fan supplies air cooled to below 0° C. to the ice maker and ice storage bin;

the method comprising:

opening the ice bin damper and operating the ice maker fan when the ice cube storage bin needs cooling and closing the ice bin damper when the ice cube bin no longer requires cooling.

35. The method of producing and storing ice pieces in a bottom freezer refrigerator according to claim 34, wherein the automatic ice maker has a quick ice mode of operation, the compressor is a variable speed compressor and the ice maker fan is arranged for at least high speed and normal speed operation and the method further comprises:

operating the compressor at high speed and the ice maker fan at high speed when the quick mode is requested; and reducing the compressor speed when the refrigerator compartment or freezer compartment temperatures are below a predetermined minimum temperature.

36. The method of producing and storing ice pieces in a bottom freezer refrigerator according to claim 35, wherein the method further comprises;

turning off the compressor speed below a predetermined minimum speed.

37. The method of producing and storing ice pieces in a bottom freezer refrigerator according to claim 35, wherein the method further comprises;

operating the ice maker fan at the normal speed when the quick ice mode is not requested.

38. The method of producing and storing ice pieces in a bottom freezer refrigerator according to claim 34, wherein the method further comprises:

operating the ice maker fan when ice is requested from the ice maker.

39. The method of producing and storing ice pieces in a bottom freezer refrigerator according to claim 34, wherein the method further comprises:

stopping the ice maker fan when ice is not requested from the ice maker and the ice cube storage bin does not require cooling.

40. An ice maker and dispenser for a bottom freezer refrigerator comprising:

a freezer compartment maintained at a temperature below 0° C.;

a refrigerator compartment positioned above the freezer compartment maintained at a temperature above 0° C.;

an insulated freezer compartment door, an insulated refrigerator compartment door;

a refrigeration system for cooling the freezer compartment and the refrigerator compartment;

an ice maker positioned in an insulated ice maker sub-compartment on the refrigerator compartment door and having a mold for forming ice pieces;

an ice cube storage bin positioned on the refrigerator door below the ice maker;

an ice dispenser positioned on the refrigerator door below the ice cube storage bin for dispensing ice pieces from the ice cube storage bin through the refrigerator door;

an air delivery system including a supply duct and a return duct leading to the ice maker and ice cube storage bin from a source of below 0° C. air for supplying air cooled to below 0° C. to the ice maker and to the ice storage bin;

an ice maker fan connected to the air delivery system wherein operation of the ice maker fan causes air from the source of below 0° C. air to flow to the ice maker and to the ice storage bin;

a first air delivery portion carried on the refrigerator door and a second air delivery portion leading from the bottom of the refrigerator door to the source of below 0° C. air wherein the first air delivery portion of the supply duct and the return duct includes a vertical portion extending from the bottom of the refrigerator door to the ice maker sub compartment; and an inlet port in the vertical portion of the supply duct adjacent the ice cube storage bin and an outlet port in the vertical portion of the return duct adjacent the ice storage bin.

41. The ice maker and dispenser for the bottom freezer refrigerator according to claim 40, further including an ice cube storage bin damper to control air flow through one or both of the inlet port and the outlet port.

42. The ice maker and dispenser for the bottom freezer refrigerator according to claim 41, further including an ice cube storage bin temperature sensor adjacent the ice cube storage bin and a control connected to the ice cube storage bin temperature sensor and to the ice cube storage bin damper, wherein the control to regulates the position of the ice cube storage bin damper in response to the temperature sensed by the ice cube storage bin temperature sensor.

43. The ice maker and dispenser for the bottom freezer refrigerator according to claim 42, wherein the ice cube storage bin damper is a two position damper arranged to open or close one or both of the inlet and outlet ports.

44. The ice maker and dispenser for the bottom freezer refrigerator according to claim 42, wherein the ice cube storage bin damper is continuously adjustable wherein the control regulates the position of the ice cube storage bin damper in response to the temperature sensed by the ice cube storage bin temperature sensor.

45. The ice maker and dispenser for the bottom freezer refrigerator according to claim 40, wherein the inlet port and the outlet port are sized to maintain the temperature of the ice cube storage bin below 0° C.

46. The ice maker and dispenser for the bottom freezer refrigerator according to claim 40, further including an inlet port in the vertical portion of the supply duct adjacent the ice cube storage bin and a ice cube storage bin damper to control air flow through the inlet port.

47. The ice maker and dispenser for the bottom freezer refrigerator according to claims 46, wherein air flowing through the inlet port to cool the ice cube storage bin flows to the refrigerator compartment after cooling the ice storage bin.

* * * * *

UNITED STATES PATENT AND TRADEMARK OFFICE

CERTIFICATE OF CORRECTION

PATENT NO. : 7,188,479 B2
APPLICATION NO. : 10/973543
DATED : March 13, 2007
INVENTOR(S) : Jeffery J. Anselmino et al.

It is certified that error appears in the above-identified patent and that said Letters Patent is hereby corrected as shown below:

Column 1, line 8, replace "US20020155" with --10/973,556--; line 9, "US20040124" should be changed to --10/973,559--.

Signed and Sealed this

Twenty-second Day of May, 2007

JON W. DUDAS
*Director of the United States Patent and Trademark Office*

UNITED STATES PATENT AND TRADEMARK OFFICE

CERTIFICATE OF CORRECTION

PATENT NO. : 7,188,479 B2
APPLICATION NO. : 10/973543
DATED : March 13, 2007
INVENTOR(S) : Jeffery J. Anselmino et al.

It is certified that error appears in the above-identified patent and that said Letters Patent is hereby corrected as shown below:

Column 19, line 39 (claim 28, line 5), replace “freezer”, first occurrence, with --refrigerator--.

Signed and Sealed this

Second Day of September, 2008

JON W. DUDAS
*Director of the United States Patent and Trademark Office*